US012685318B1

(12) United States Patent
Brenner

(10) Patent No.: US 12,685,318 B1
(45) Date of Patent: Jul. 21, 2026

(54) CONTINUOUS FLOW FOOD PREPARATION DEVICE

(71) Applicant: Robert Edward Brenner, Hartford, SD (US)

(72) Inventor: Robert Edward Brenner, Hartford, SD (US)

(73) Assignee: Robert Brenner, Hartford, SD (US)

( * ) Notice: Subject to any disclaimer, the term of this patent is extended or adjusted under 35 U.S.C. 154(b) by 0 days.

(21) Appl. No.: 19/368,542

(22) Filed: Oct. 24, 2025

Related U.S. Application Data

(63) Continuation of application No. PCT/US2025/051246, filed on Oct. 16, 2025.

(60) Provisional application No. 63/936,250, filed on Aug. 24, 2025, provisional application No. 63/870,587, filed on Aug. 26, 2025.

(51) Int. Cl.
*A23B 4/052* (2006.01)
*A47J 37/06* (2006.01)
*F24C 15/32* (2006.01)

(52) U.S. Cl.
CPC ..... *A23B 4/0523* (2013.01); *A47J 37/06* (2013.01); *F24C 15/32* (2013.01)

(58) Field of Classification Search
CPC ..... A23B 4/0523; F24C 15/32; F24B 5/04; F24B 7/04; F24B 7/045; A47J 37/07; A47J 37/074
See application file for complete search history.

(56) References Cited

U.S. PATENT DOCUMENTS

| | | | | |
|---|---|---|---|---|
| 1,060,837 | A | 5/1913 | Gohmann | |
| 1,268,337 | A | 6/1918 | Fisch | |
| 4,831,238 | A | 5/1989 | Smith et al. | |
| 9,930,897 | B2 | 4/2018 | Blue et al. | |
| 12,382,971 | B2 | 8/2025 | Powell et al. | |
| 2004/0060553 | A1* | 4/2004 | Laitinen | F24B 5/026 126/61 |
| 2014/0026880 | A1 | 1/2014 | Froelicher et al. | |
| 2015/0201805 | A1* | 7/2015 | Cedar | A47J 37/0786 320/101 |
| 2015/0237872 | A1 | 8/2015 | Engstrom | |
| 2017/0094984 | A1* | 4/2017 | Blue | A23B 4/052 |
| 2025/0257876 | A1 | 8/2025 | Baker et al. | |

FOREIGN PATENT DOCUMENTS

DE 102023203394 A1 11/2023

OTHER PUBLICATIONS

Lang BBQ Smokers, "Reverse Flow—Why is it so terrific?", https://langbbqsmokers.com/resources/faqs/reverse-flow/, May 21, 2020.

(Continued)

*Primary Examiner* — Steven W Crabb
*Assistant Examiner* — Dilnessa B Belay
(74) *Attorney, Agent, or Firm* — Kinney & Lange, P.A.

(57) ABSTRACT

A cooker is formed as a continuous flow food preparation device. The cooker includes a cook pathway that extends between a heating chamber and an exhaust. The cook pathway is formed as a serpentine passage that includes at least two flow chambers. The output from the heating chamber flows serially through the flow chambers forming the cook pathway.

20 Claims, 21 Drawing Sheets

(56) References Cited

OTHER PUBLICATIONS

Simply Meat Smoking, "How to Use an Offset Smoker (Use it Like a True Pitmaster)", https://www.simplymeatsmoking.com/cooking-knowledge/how-to-use-an-offset-smoker/, Oct. 26, 2022.
Smokerbuilder, "What is the difference between reverse flow, tuning plate, and vertical baffle smokers?", https://info.smokerbuilder.com/what-is-the-difference-between-reverse-flow-tuning-plate-and-vertical-baffle-smokers, Oct. 15, 2024.
International Search report and Written Opinion for International Patent Application No. PCT/US2025/051246, dated Dec. 15, 2025, 11 pages.

* cited by examiner

CONTINUOUS FLOW FOOD PREPARATION DEVICE

CROSS-REFERENCE TO RELATED APPLICATIONS

The present application is a continuation of International Application No. PCT/US2025/051246 filed Oct. 16, 2025 and entitled "CONTINUOUS FLOW FOOD PREPARATION DEVICE," which in turn claims the benefit of U.S. Provisional Application No. 63/936,250 filed Aug. 24, 2025 and entitled "CONTINUOUS FLOW FOOD PREPARATION DEVICE," and claims the benefit of U.S. Provisional Application No. 63/870,587 filed Aug. 26, 2025, and entitled "CONTINUOUS FLOW FOOD PREPARATION DEVICE," the disclosures of which are hereby incorporated by reference in their entireties.

BACKGROUND

This disclosure relates to food preparation devices for preparing foodstuffs. More specifically, this disclosure relates to cookers such as for cooking and/or smoking of foodstuffs.

Foodstuffs can be prepared for consumption by heating or treating, such as with smoke. Foodstuff can be prepared for consumption by subjecting the raw foodstuff to sufficient heat to cook the product to an appropriate level of doneness. Various ovens are used for roasting, broiling, smoking or barbequing meats. The foodstuff is typically placed on racks inside a cooking chamber and subjected to heat and/or smoke. The heat and/or smoke are intended to impart desired flavor and, in some instances, aesthetic appearance to the prepared foodstuff. Traditional cookers have irregular and erratic flow patterns (heat and/or smoke) that produce inconsistent heat form cooking and/or smoking. Such irregular and erratic flow patterns can cause the foodstuffs to become over- or under-cooked.

SUMMARY

According to an aspect of the disclosure, a cooker configured to prepare a foodstuff includes a cooker housing defining a cooking chamber; a first flow divider disposed within the cooker housing; a cooker passage extending within the cooker housing and configured to convey an outflow from a heating chamber to an exhaust, the cooker passage including a plurality of flow passages, wherein a first flow passage of the plurality of flow passages is disposed vertically below a second flow passage of the plurality of flow passages, and the heating chamber is disposed vertically below the first flow passage; a plurality of racks disposed within the cooker housing, wherein a first rack of the plurality of racks is disposed in the first flow passage and a second rack of the plurality of racks is disposed in the second flow passage; wherein the cooker passage is a serpentine passage that extends from the heating chamber to the first flow passage, then to the second flow passage, and then to the exhaust.

According to an additional or alternative aspect of the disclosure, a cooker configured to prepare a foodstuff includes a cooker housing defining a cooking chamber; a first flow divider disposed within the cooker housing; a first flow passage at least partially defined by the first flow divider; a heating chamber configured to generate an output that flows through the first flow passage to prepare the foodstuff within the first flow passage, the heating chamber disposed vertically below the first flow passage; a rack disposed within the cooker housing and at least partially within the first flow passage; and a flow inhibitor disposed at a downstream end of the first flow passage, the flow inhibitor configured to at least partially block the first flow passage to direct flow of the output from the first flow passage.

DETAILED DESCRIPTION

Figure 1A:
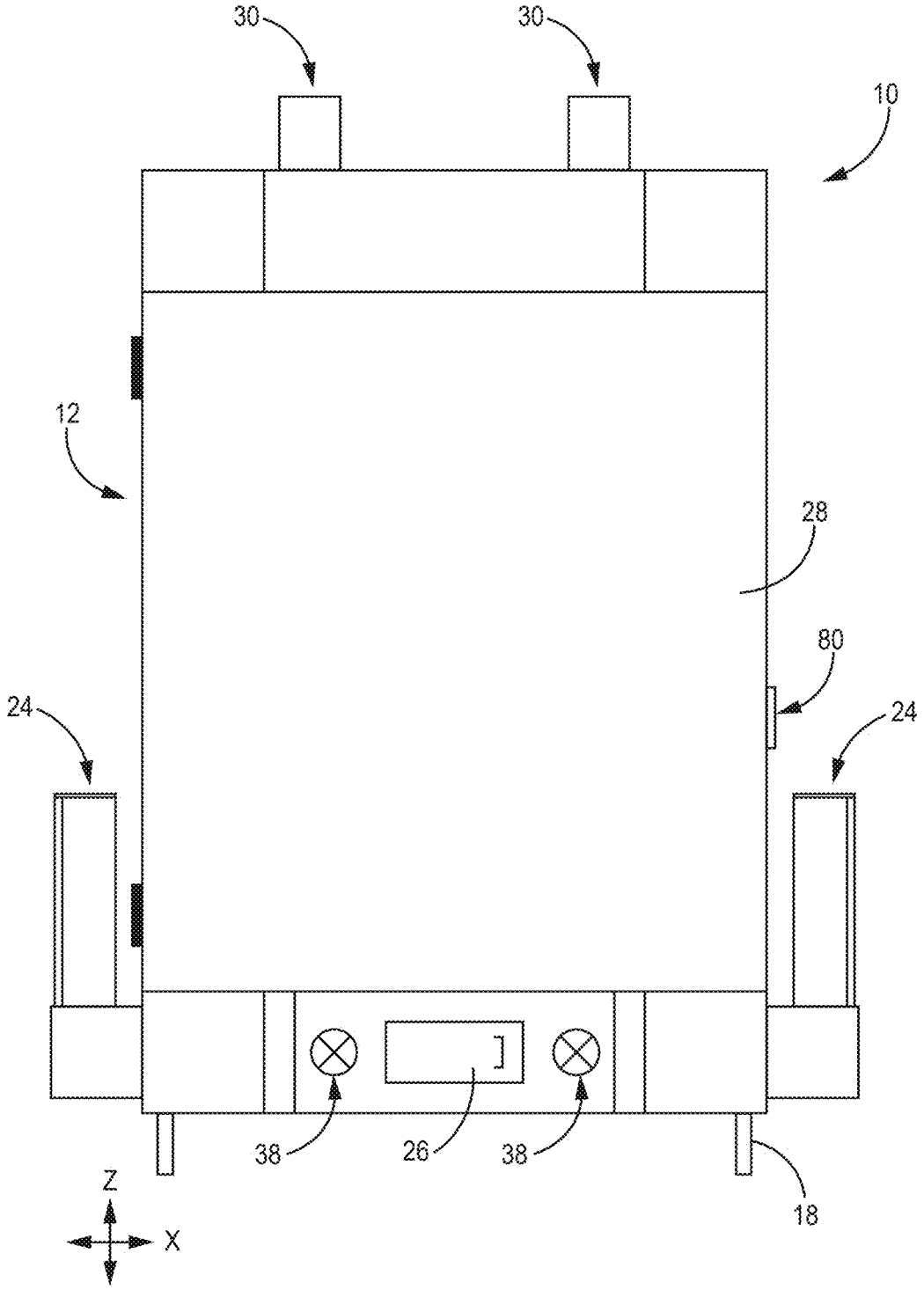
FIG. 1A is a front view of a cooker.

According to aspects of the disclosure, a cooker is configured to cook foodstuffs by a continuous offset flow. The continuous flow offset pulls heat and/or smoke from a heating chamber and through a serpentine cooking pathway. The foodstuffs are disposed in the serpentine pathway and are exposed to the output from a heating chamber that travels through the cooking pathway. The cooking pathway creates consistent flow through the cooking chamber such that the foodstuffs being prepared are cooked and/or smoked in an even, thorough, and consistent manner.

According to some aspects of the disclosure, a cooking chamber of the cooker includes a cooking pathway that includes at least two flow passages. The flow passages are disposed downstream of a heating chamber. The heating chamber is the source of the heat and/or smoke that is applied to the foodstuff. The flow passages are vertically offset from each other and can be disposed in a stacked manner. The output from the heating chamber travels through multiple, up to all, of the flow passages of the cooking pathway to an exhaust from which the output is exhausted from the cooking chamber. The output from the heating chamber travels in opposed directions through the at least two flow passages. For example, the output from the heating chamber can flow in a first direction (e.g., laterally or longitudinally) through a first flow passage and the output then turns and moves vertically to a second flow passage. The output can flow in a second direction (e.g., the other lateral or longitudinal direction) through the second flow passage. The flow directions through vertically adjacent pathways can be in opposed directions. It is understood that the cooking pathway can include two flow passages or more than two flow passages.

Cookers according to various aspects of the disclosure include a flow inhibitor that provides for even cooking. The flow inhibitor is configured to block flow of the output from the heating chamber along various portions of the cooking pathway. The flow inhibitor can physically block portions of the flow through flow passages of the cooking pathway. The flow inhibitor can channel and direct heat and/or smoke onto the foodstuffs which can provide for improved cooking efficiency and improved cooking consistency throughout the cooking chamber. The flow inhibitor can be disposed at the downstream end of a flow passage, though it is understood that not all examples are so limited.

According to various aspects of the disclosure, a flow inhibitor that at least partially blocks flow of the output from the heating chamber is adjustable to change the flow and/or blockage of the flow. For example, the flow inhibitor can be placed in a first state in which a first portion of the flow is blocked and in a second state in which a second portion of the flow is blocked. The second portion can include the first portion plus additional portions of the flow. For example, the flow inhibitor can have different lengths that can block larger or smaller portions of the flowpath through the cooking pathway.

Flow inhibitors according to some aspects of the disclosure include at least one baffle configured to at least partially block the flow. The baffle can span across the flow passage transverse to the flow direction trough the flow passage. The baffle can span across a majority, up to all, of a width of the flow passage. The baffle is configured to extend into the flow passage to block a portion of the flow passage such that the output is directed to a portion of the flow passage by the baffle.

The flow inhibitor can, in various examples, include a plurality of baffles. The plurality of baffles can include a first baffle having a first length and a second baffle having a second length different from the first length. In some examples the plurality of baffles can include a third baffle having a third length that is different from the first length and different from the second length. The different sizes between the multiple baffles allows for adjusting the flow conditions though the flow passage. For example, a longer baffle will extend further across the flow passage than a shorter baffle. The longer baffle extending further across the flow passage blocks a larger portion of the flow passage than the shorter baffle.

In various examples, the flow inhibitor can be adjusted based on the foodstuff being prepared. In some cases, the flow inhibitor can be adjusted based on a vertical height of the foodstuff being prepared. The flow inhibitor is sized to cause the output from the heating chamber (e.g., heat and/or smoke) to be retained on the foodstuff, providing for improved flavor and cooking efficiency.

Flow inhibitors according to aspects of the disclosure can be actuated between deployed and stowed states. The flow inhibitor can be disposed in the stowed state to allow free flow through the cooking pathway. The flow inhibitor can be disposed in the deployed state to at least partially block the flow through the cooking pathway. In various examples, the flow inhibitor can be deployed in one of a plurality of deployed states. For example, the flow inhibitor can be deployed in a first state in which the flow inhibitor blocks a portion of the flow passage and the flow inhibitor can be deployed in a second state in which the flow inhibitor blocks a larger portion of the flow passage than when in the first state.

Cookers according to various aspects of the disclosure include flow dividers. The flow dividers are disposed vertically between flow passages within the serpentine cooking pathway. According to various examples, the flow dividers are formed as drip pans that divide the flow passages in the cooking chamber. The drip pans extend less than the full length of the cooking chamber such that the serpentine coking pathway can wrap around the drip pans between flow passages. In some examples, the drip pans are offset (e.g., laterally or longitudinally) to form the serpentine cooking pathway. The drip pan is configured to block direct flow between vertically adjacent flow passages.

Cookers according to aspects of the disclosure include heating cables within a body of the cook housing. The heating cables are configured to generate heat that is transmitted through an inner skin of the body to the cooking chamber. In some examples, the heating cables can provide sufficient heat for cooking within the cooking chamber without requiring an output from the heating chamber. In some examples, the heating cables provide sufficient heat for holding a foodstuff at a desired temperature, which may be cooler than a minimum temperature that can be output from the heating chamber.

It is understood that cookers according to aspects of the disclosure can utilize any desired fuel type, such as wood, charcoal, pellets, propane, natural gas, electric heating, etc.

According to various aspects of the disclosure, the serpentine cooking pathway, the flow inhibitor, and/or the integrated drip pans can be utilized to retrofit an existing cooker to provide improved cooking efficiency and improved quality of the prepared foodstuff.

Figure 1B:
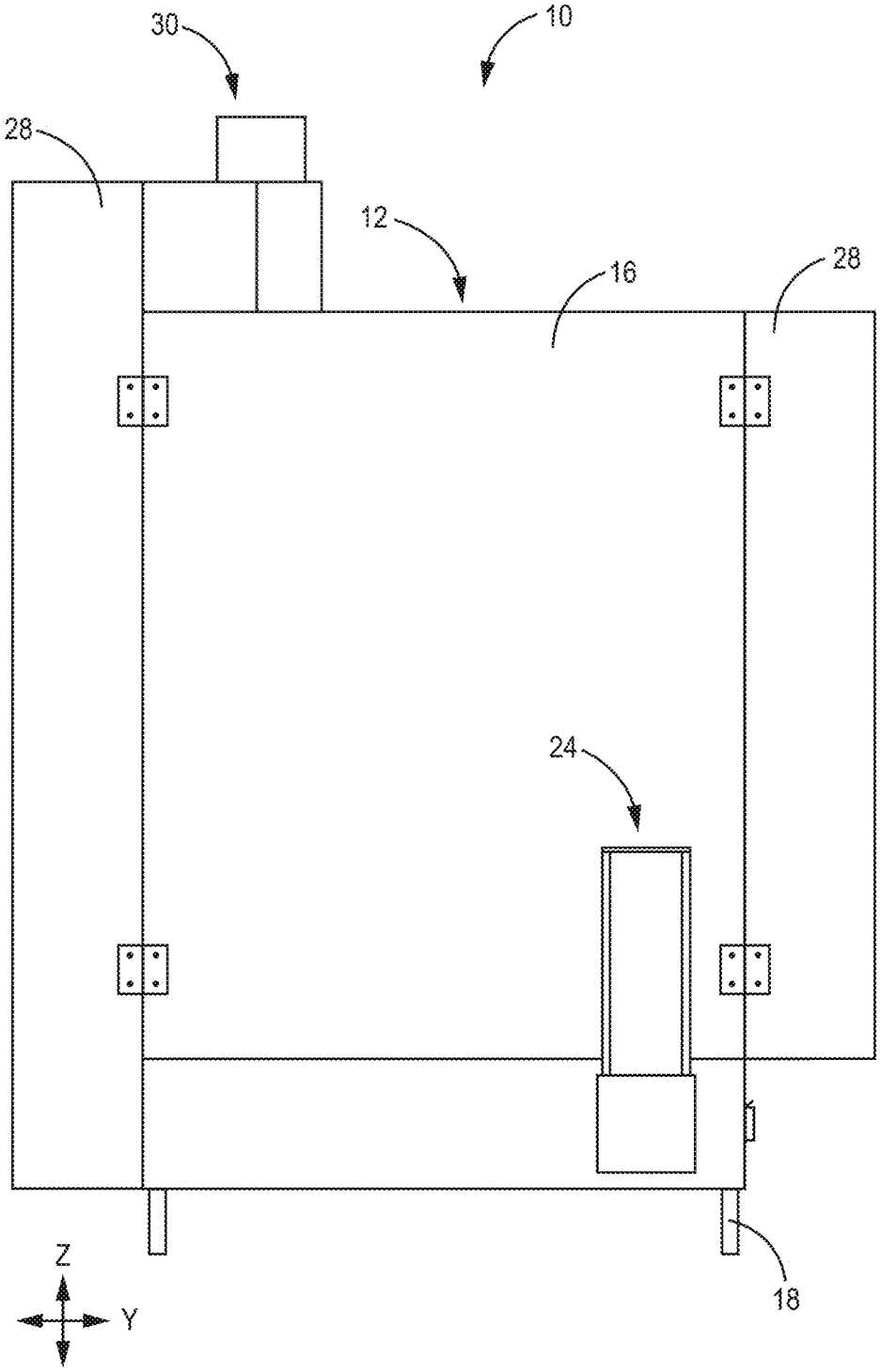
FIG. 1B is a side view of the cooker.
Figure 1C:
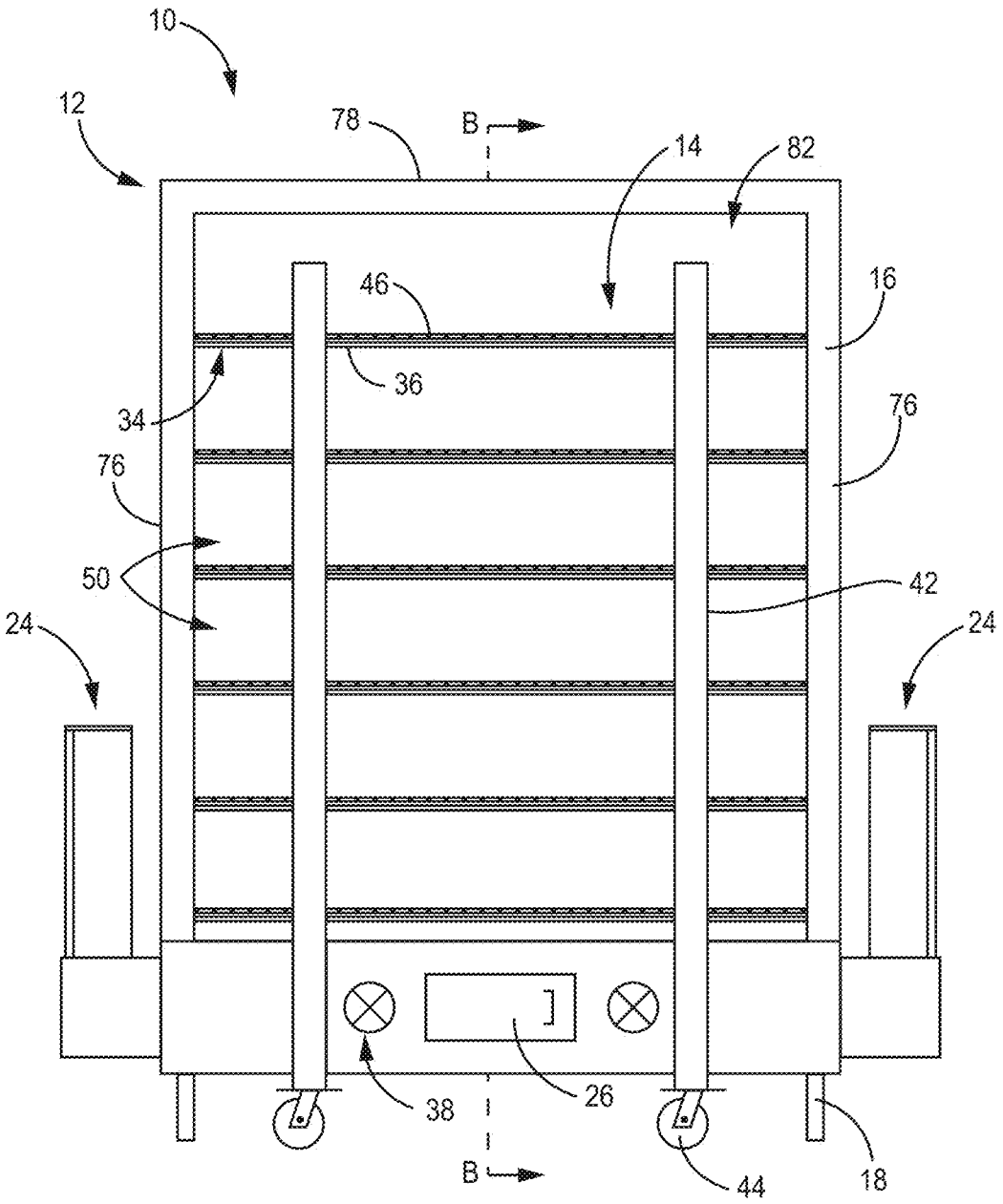
FIG. 1C is a front view of the cooker with doors removed to expose an interior of the cooker.
Figure 1D:
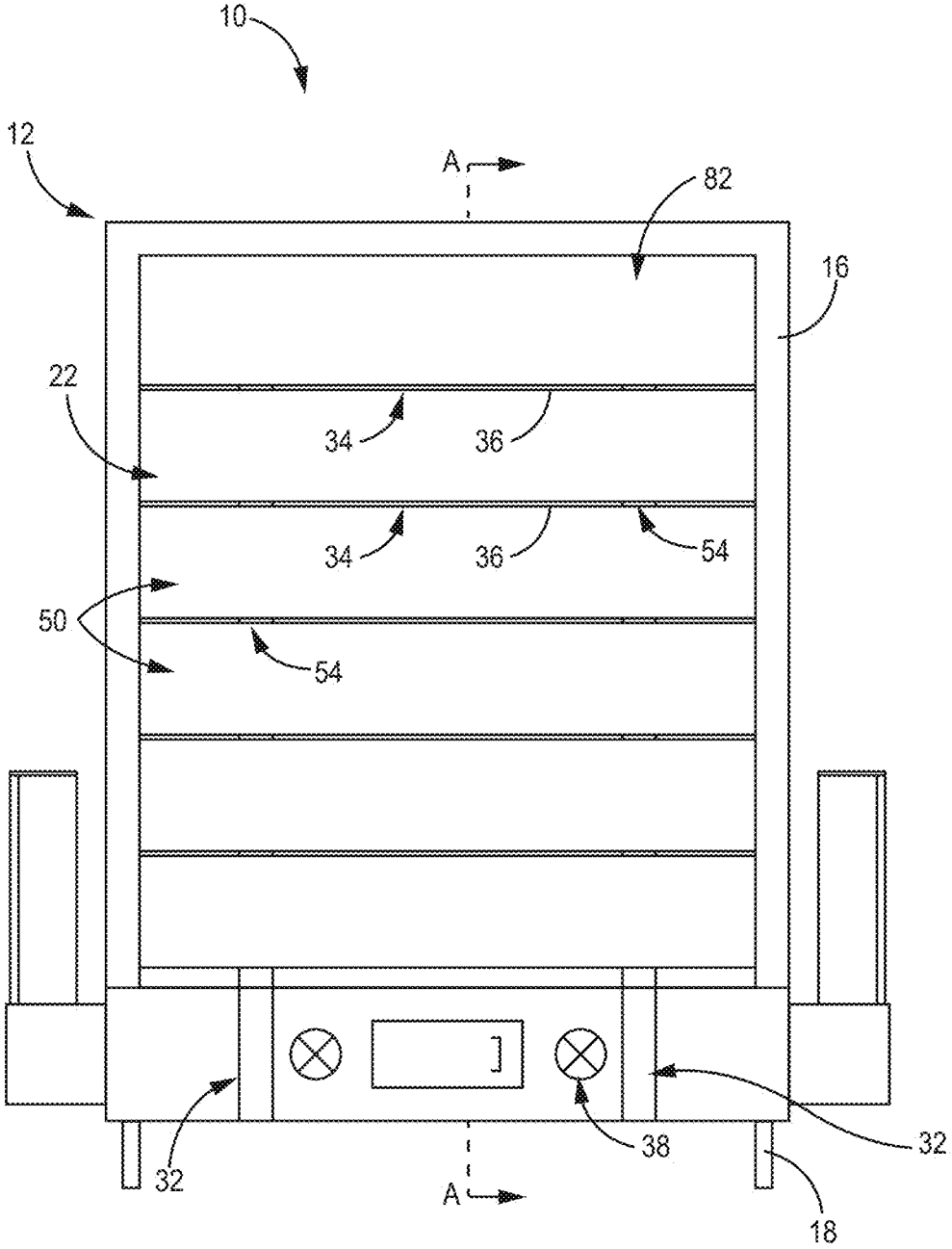
FIG. 1D is a front view of the cooker with doors and a rack assembly removed to expose an interior of the cooker.
Figure 2A:
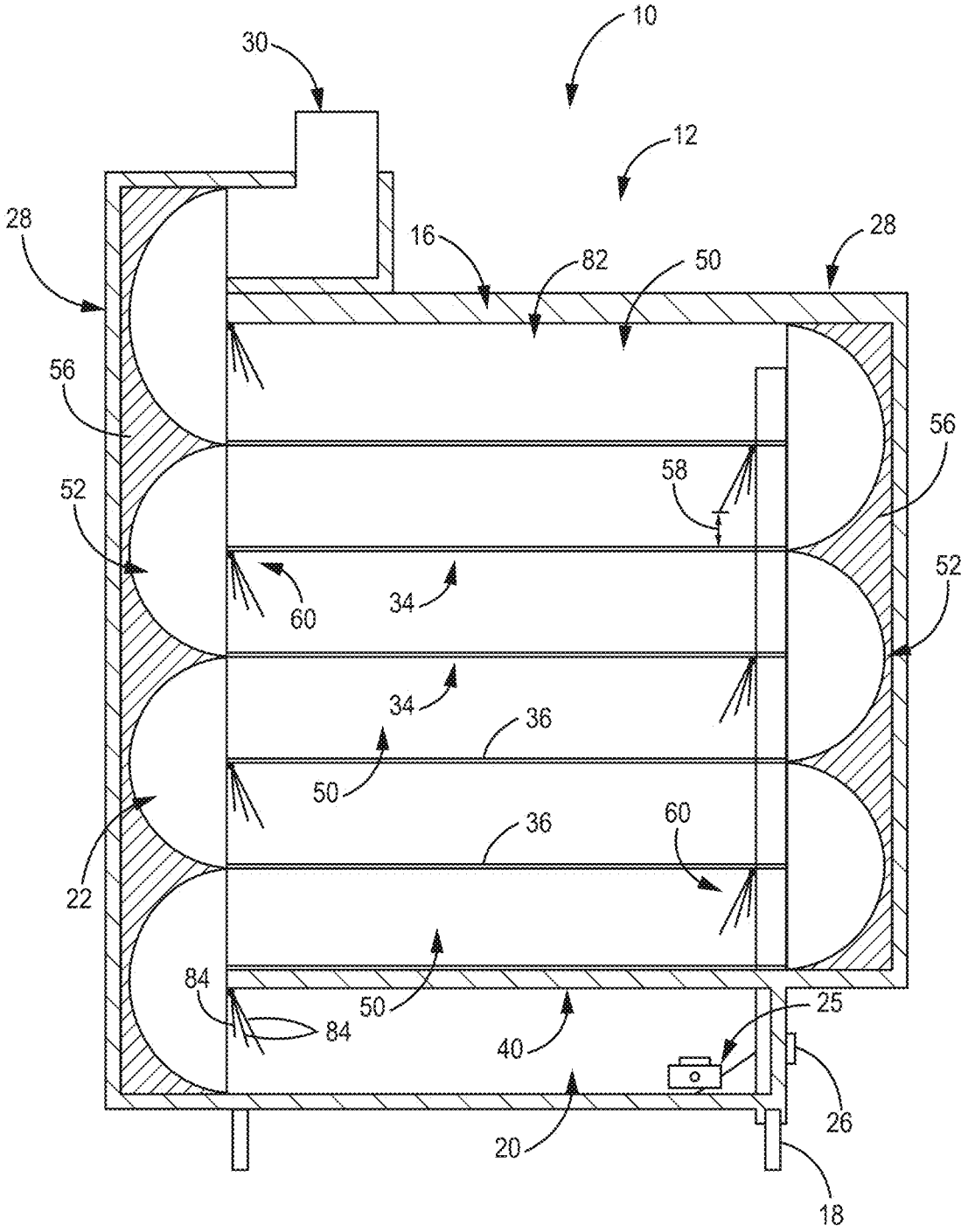
FIG. 2A is a cross-sectional view of the cook housing.
Figure 2B:
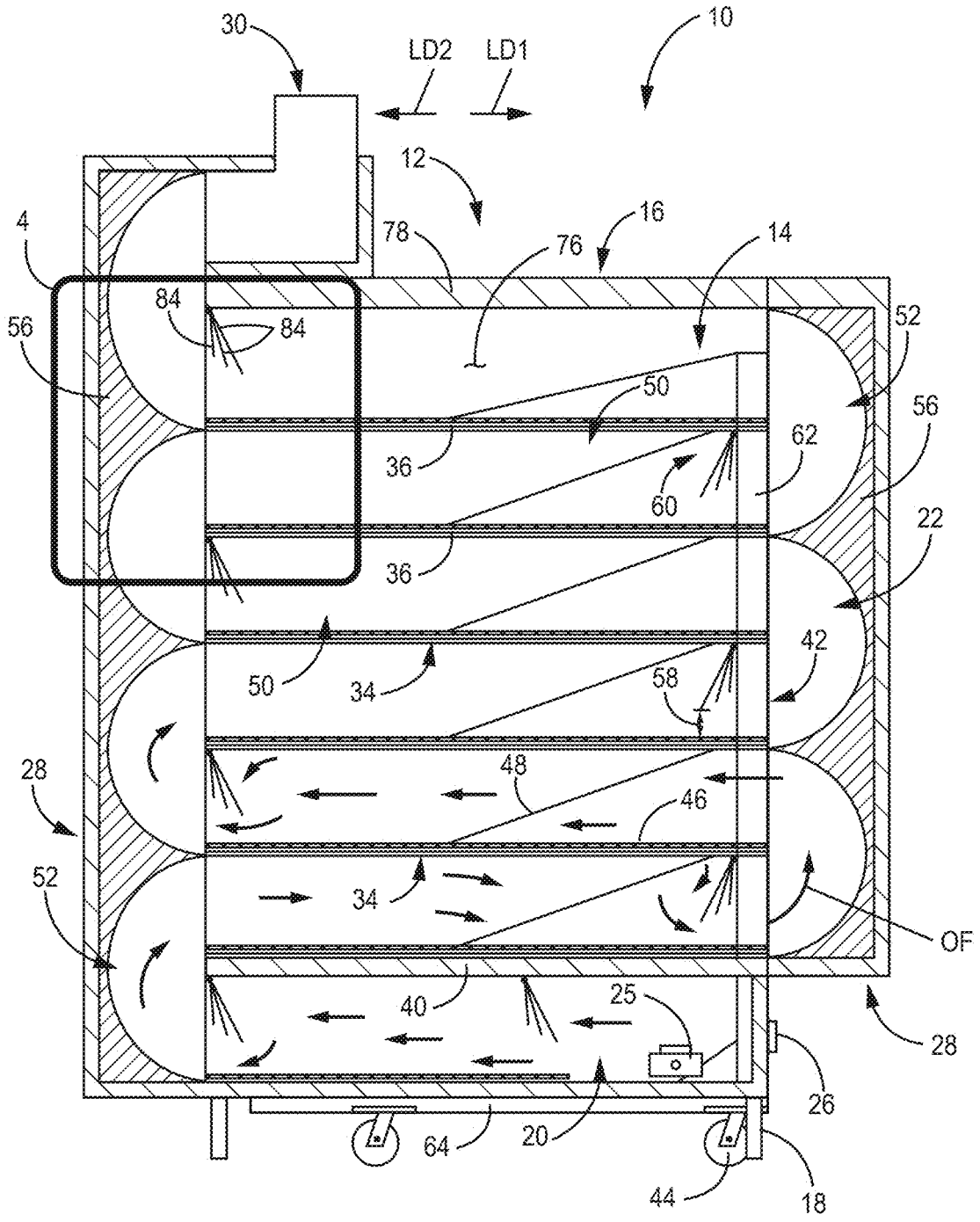
FIG. 2B is a cross-sectional view of the cooker.

FIG. 1A is a front view of cooker 10. FIG. 1B is a side view of cooker 10. FIG. 1C is a front view of cooker 10 with housing doors 28 removed to expose an interior of the cooker 10. FIG. 1D is a front view of the cooker 10 with housing doors 28 and rack assembly 14 removed to expose an interior of the cooker 10. FIG. 2A is a cross-sectional view of cook housing 12 taken along line A-A in FIG. 1D. FIG. 2B is a cross-sectional view taken along line B-B in FIG. 1C. FIGS. 1A-2B are discussed together.

Cook housing 12, rack assembly 14, housing body 16, stand 18, heating chamber 20, cook pathway 22, fuel source 24, chamber door 26, housing doors 28, exhaust 30, flow dividers 34, air intakes 38, divider wall 40, and flow inhibitors 60 of cooker 10 are shown. Rack assembly 14, includes assembly frame 42, wheels 44, racks 46, and brackets 48. Cook pathway 22 is formed by flow passages 50 and includes passage bends 52. X-Z coordinate axes are shown in FIG. 1A. The X axis is a lateral axis and the Z axis is a vertical axis. Y-Z coordinate axes are shown in FIG. 1B. The Y axis is a longitudinal axis and the Z axis is a vertical axis.

Cooker 10 is configured to prepare foodstuffs, such as by smoking and/or cooking with heat and/or smoke. Cook housing 12 contains various components of cooker 10. Stand 18 supports cook housing 12. Stand 18 can be formed by one or more legs, among other options. Housing body 16 forms a main body portion of the cooker 10. Housing doors 28 are connected to housing body 16 to form the cook housing 12. In the example shown, rack assembly 14 is configured to interface with cook housing 12 and can be removed from cook housing 12 as a single assembly.

The foodstuffs are placed on the racks 46 of rack assembly 14 for insertion into cook housing 12 and removal from cook housing 12. Racks 46 are supported by assembly frame 42. In the example shown, the assembly frame 42 includes a vertical portion from which the racks 46 extend and a horizontal portion. Wheels 44 of the rack assembly 14 are connected to the horizontal portion. The wheels 44 are configured to roll on a ground surface to facilitate moving of the rack assembly 14, such as into and out of the cook housing 12. Brackets 48 connect between racks 46 and assembly frame 42. Brackets 48 provide additional support to hold the racks 46 on the assembly frame 42. Brackets 48 can be formed as rods, plates, etc.

Housing door 28 is supported by housing body 16. Housing door 28 can be opened to expose the cooking chamber 82 within cook housing 12. In the example shown, the cooker 10 includes a first housing door 28 at a front end of cooker 10 and cooker 10 includes a second housing door 28 at a second end of cooker 10. The housing door 28 at the front end of cooker 10 can be opened to allow for insertion or removal of rack assembly 14. The housing door 28 at the rear end of cooker 10 can be opened to allow the user access to the foodstuffs within the cooking chamber 82, such as for individual inspection or adjustment. The housing doors 28 are disposed at longitudinal ends of the cook housing 12. Rack assembly 14 is configured to move longitudinally relative to cook housing 12 during insertion and removal.

Fuel source 24 is mounted to cook housing 12. Fuel source 24 is mounted to housing body 16. It is understood that various examples of cooker 10 do not include a fuel source 24 mounted to the cook housing 12. For example, fuel can be placed directly in the heating chamber 20 (e.g., wood logs, charcoal, among other options). Fuel source 24 is configured to provide fuel to heating chamber 20. The fuel source 24 can be formed as a hopper configured to feed fuel to the heating chamber 20. The fuel source 24 can be a gravity feed hopper, a pellet hopper with powered auger, a propane tank, among other options. While cooker 10 is shown as including multiple fuel sources 24, it is understood that cooker 10 can include a single fuel source 24 or can include no external fuel source 24. Fuel source 24 can provide fuel to outer generator 25 disposed in heating chamber 20. Output generator 25 can be configured to provide smoke and/or heat. Output generator 25 can be configured as a gas burner in some examples. Output generator 25 can be configured as a combustor in which wood, charcoal, etc. is combusted (e.g., such as by feeding of wood pellets). It is understood that various examples of cooker 10 may not include an output generator 25, such as in examples in which wood, charcoal, etc. is burned within heating chamber 20.

Heating chamber 20 is formed within cook housing 12. Heating chamber 20 is formed in a vertically lower portion of housing body 16. Heat and/or smoke are generated in heating chamber 20 and flow through cook pathway 22 to prepare the foodstuff. For example, fuel can be combusted within heating chamber 20 to generate heat and/or smoke for preparing the foodstuff.

Chamber door 26 provides access to heating chamber 20. Chamber door 26 can be opened to allow the user access to heating chamber 20 and can be closed to block heating chamber 20. For example, a user can open the chamber door 26 to provide access to add additional fuel to heating chamber 20.

Air intakes 38 are formed in housing body 16. Air intakes 38 are in fluid communication with heating chamber 20. The air intakes 38 provide pathways for air to enter into heating chamber 20 and flow through the cook pathway 22. In various examples, the air intakes 38 are adjustable to control the airflow into the cook pathway 22. The flow through the air intakes 38 can be adjusted to control a target temperature for the cooker 10. For example, the air intakes 38 can be adjusted further open to provide increased airflow and to raise the target temperature or the air intakes 38 can be adjusted further closed to provide decreased airflow and reduce the target temperature. In some examples, the air intakes 38 are configured to be manually adjusted. In some additional or alternative examples, the air intakes 38 can be operably connected to a controller such that the controller can cause the air intakes 38 to further open or close to control the temperature within cooking chamber 82.

Flow dividers 34 are disposed in cook housing 12. In the example shown, flow dividers 34 are disposed in and supported by housing body 16. The flow dividers 34 can extend fully laterally across the cooking chamber 82. The flow dividers 34 extend between the interior lateral walls of the cook housing 12. In the example shown, the flow dividers 34 extend a full longitudinal length of the cook housing 12, though it is understood that not all examples are so limited. In various other examples, adjacent flow dividers 34 (e.g., vertically adjacent) can be offset from each other (e.g., longitudinally or laterally depending on the orientation of the cook pathway 22) to provide space for the output from the heating chamber 20 to flow between flow passages 50.

In the example shown, the flow dividers 34 are formed by drip pans 36 disposed within the cook housing 12. It is understood, however, that not all examples of flow dividers 34 includes a drip pan 36. In some examples, the flow divider 34 can be formed as a solid sheet (e.g., metal plate among other options) and a rack 46 and/or drip pan 36 can be placed on the solid sheet forming the flow divider 34. The drip pans 36 can interface with housing body 16 to divide the flow passages 50. The drip pans 36 are configured to catch any drippings (e.g., grease, fat, etc.) from the foodstuff in the rack 46 directly above the drip pan 36. The drip pan 36 catching the drippings prevents the drippings from falling onto any foodstuffs on a vertically lower one of racks 46, which can impact flavor, appearance, etc. Drip pans 36 can be formed with a vertically extending rim that prevents the drippings from spilling over the side of the drip pan 36.

In various examples, the drip pans 36 can be fluidly connected to allow draining of any liquid that collects in the drip pan 36. For example, the drip pans 36 can include openings that allow the liquid to drain vertically downwards. In various examples, the racks 46 can be configured with indicators regarding the position of the openings in the drip pan 36. Such indicators inform the user of the location that any liquid will drain from drip pan 36 located directly vertically above the rack 46, allowing the user to position the foodstuffs to avoid the draining liquid falling directly onto the foodstuff. In some examples, the drip pans 36 can be fluidly connected to a collection chamber that captures the drippings. For example, each drip pan 36 can be contoured to direct flow of any liquid towards a particular location on the drip pan 36. The drip pan 36 can be contoured to route the liquid to a drain line that leads to the collection chamber. For example, the drain line can be formed in a side wall 76 of the housing body 16, among other options.

It the example shown, the drip pans 36 are vertically aligned with each other. Passage bends 52 are formed in housing doors 28 to provide space for the output from the heating chamber 20 to flow between flow passages 50. In the example shown, the cook pathway 22 extends outward beyond both ends of the flow divider 34 in the flow direction of the output from the heating chamber 20. The cook pathway 22 extends longitudinally outward of the drip pans 36 on both longitudinal ends of the drip pans 36. It is understood that the cook pathway 22 can extends laterally outward of the drip pans 36 on both lateral sides of the drip pans 36 in various other examples.

Pan guides 54 are formed in the drip pans 36. The pan guides 54 are formed in a longitudinal end of the drip pans 36. Pan guides 54 can be formed as notches in the ends of the drip pans 36. Housing guides 32 are formed in housing body 16. The housing guides 32 and pan guides 54 are aligned to form a receiver into which the assembly frame 42 of the rack assembly 14 is inserted. In the example shown, the housing guides 32 and pan guides 54 are vertically aligned such that a vertical portion of the assembly frame 42 inserts into the receiver. The pan guides 54 and housing guides 32 receiving the assembly frame 42 allows for a close fit of the assembly frame 42 within the cook housing 12 to form the serpentine cook pathway 22.

Cook pathway 22 is configured to direct the output from heating chamber 20 through cooking chamber 82 and to exhaust 30. Cook pathway 22 is a serpentine pathway in the example shown. Cook pathway 22 includes multiple flow passages 50 that are fluidly connected by passage bends 52. In the example shown, the cook pathway 22 extends vertically between the heating chamber 20 and the exhaust 30.

Flow passages 50 are disposed within cook housing 12. Flow passages 50 are vertically stacked. The flow passages 50 are fluidly connected together to allow for flow of the output from the heating chamber 20 through the multiple flow passages 50. In the example shown, the flow passages 50 are serially connected such that the output from the heating chamber 20 flows through a first flow passage 50, then through a second flow passage 50, and then through any additional flow passages 50 before reaching the exhaust 30. The cook pathway 22 is configured to prevent flow of the output directly between adjacent flow passages 50. Instead, the output is directed out of an upstream flow passage 50, through a passage bend 52, and then into a downstream flow passage 50.

In the example shown, cooker 10 does not blow the output from heating chamber 20 through the cook pathway 22. Instead, the output can be convectively drawn through the cook pathway 22. While the serial flow is not blow or forced through the flow passages 50 in this example, it is understood that not all examples are so limited. For example, cooker 10 can include one or more fans that force the air through the cooking pathway 22. Cooker 10 can include a fan configured to blow the output through cook pathway 22. Cooker 10 can additionally or alternatively include a fan configured to draw the output through cook pathway 22, such as a fan disposed proximate exhaust 30.

Flow dividers 34 are disposed between adjacent flow passages 50. Flow dividers 34 are configured to separate the adjacent flow passages 50 to cause the serial flow through the flow passages 50. It is understood that the flow dividers 34 may not provide air-tight sealing between the flow passages 50. For example, the flow dividers 34 can be mounted on or adjacent to surfaces and can prevent direct flow by such interfacing (e.g., a metal-to-metal interface). In some examples, however, the flow dividers 34 can provide air-tight sealing between flow passages 50. The flow dividers 34 cause a substantial majority of the output to follow the serpentine cook pathway 22 between heating chamber 20 and exhaust 30.

Passage bends 52 are configured to direct flow between flow passages 50. In the example shown, an upstream passage bend 52 directs flow from the heating chamber 20 to an upstream-most flow passage 50; a downstream passage bend 52 directs flow from a downstream-most flow passage 50 to exhaust 30; and intermediate ones of the passage bends 52 direct flow between flow passages 50.

In the example shown, passage bends 52 are formed in housing doors 28. It is understood, however, that not all examples are so limited. Housing doors 28 include insulation 56 within the interior of the housing door 28. The insulation 56 assists in maintaining the temperature within cooking chamber 82. The passage bends 52 are configured to guide flow between flow passages 50. The passage bends 52 are configured to route the output from an upstream flow passage 50 to a next flow passage 50 downstream of the upstream flow passage 50. In the example shown, the passage bends 52 are configured to reroute a direction of the flow between the adjacent flow passages 50. For example, the passage bend 52 can provide a turn of about 180-degrees between the serially adjacent flow passages 50.

In the example shown, the passage bends 52 include at least one curved surface for redirecting the flow between flow passages 50. Passage bends 52 can include an upper curved surface. Passage bends 52 can additionally or alternatively include a lower curved surface. While passage bends 52 include at least one curved surface in this example, it is understood that not all examples are so limited. For example, passage bends 52 can have squared corners, among other options.

Cook pathway 22 is configured such that the flow direction of the output changes between adjacent flow passages 50. In the example shown, the flow direction is longitudinal within the flow passages 50 and reverses in longitudinal direction between adjacent flow passages 50. It is understood that the flow direction can be lateral within the flow passages in various other examples. In the example shown, the output flow (indicated with arrows OF) is in a first direction LD1 within the upstream-most flow passage 50 and is in the opposite direction LD2 within the flow passage 50 directly downstream of the upstream-most flow passage 50.

Divider wall 40 is disposed between cooking chamber 82 and heating chamber 20. Divider wall 40 includes interior insulation. Divider wall 40 is configured to prevent direct heating of foodstuffs by heat generated in the heating chamber 20. Such a configuration provides for more even heating and preparation of the foodstuffs throughout cooker 10. It is understood, however, that some examples can include a portion of cooking chamber that is laterally and/or longitudinally aligned with the heating chamber 20, such as shown in FIG. 2B. Such a configuration can include, but does not necessarily include, a flow inhibitor 60 between the heating chamber 20 and that aligned portion of the cooking chamber 82.

Cooker 10 includes flow inhibitors 60 in the example shown. The flow inhibitors 60 are associated with the flow passages 50. Flow inhibitor 60 is configured to block at least a portion of the flow through an associated flow passage 50. In this example, each flow passage 50 has an associated flow inhibitor 60. It is understood, however, that each flow passage 50 can be associated with one or more flow inhibitors 60 and that in various examples, some flow passages 50 do not include an associated flow inhibitor 60.

Flow inhibitor 60 is configured to extend at least partially across an associated flow passage 50. Flow inhibitor 60 extends transverse to the flow direction through the flow passage 50. Flow inhibitor 60 can extend at least partially across a vertical extent of the flow passage 50. The flow inhibitor 60 extends downwards from an upper side of the flow passage 50. The flow inhibitor 60 is configured such that the output flows vertically below the flow inhibitor 60 to pass by the flow inhibitor 60.

Flow inhibitor 60 is disposed in a downstream portion of the associated flow passage 50. It is understood, however, that not all examples are so limited. Flow inhibitor 60 being disposed at a downstream end of the flow passage 50 assists in retaining the output from the heating chamber 20 within the flow passage 50. For example, the flow inhibitor 60 can assist in retaining heat and/or smoke within a flow passage 50. The output from the heating chamber 20 is inhibited prevented from flowing around the foodstuff at locations vertically over the foodstuff in the flow passage 50. The output from the heating chamber 20 exits the flow passage 50 at a vertically lower location to provide desired interface with the foodstuff.

Flow inhibitor 60 is reconfigurable to adjust a size of the flow gap 58 defined by the flow inhibitor 60. The flow gap 58 is formed vertically between a distal end of the flow inhibitor 60 and the base of the flow passage 50. The output is configured to exit from the flow passage 50 through the flow gap 58. According to various examples, the flow inhibitor 60 can be actuated between different lengths to change the size of the flow gap 58, thereby increasing restriction of the flow or reducing restriction of the flow.

In the example shown, the flow inhibitor 60 includes a plurality of baffles 84. The baffles 84 have different lengths such that each baffle 84 provides for a differently sized flow gap 58. One baffle 84 has a first length and spans across a first portion of the flowpath through the associated flow passage 50. Another baffle 84 has a second length greater than the first length such that the baffle 84 spans across a second portion of the flow passage 50 in addition to the first portion of the flow passage 50.

The plurality of baffles 84 includes three baffles 84 in the example shown. It is understood, however, that not all examples are so limited. In some examples, the flow inhibitor 60 can be formed by a single baffle 84. In examples including multiple baffles 84, the flow inhibitor 60 can includes two baffles 84, three baffles 84, or any other desired number of baffles 84.

While flow inhibitor 60 is shown as formed by multiple baffles 84 having different lengths, it is understood that not all examples are so limited. For example, the flow inhibitor 60 can be formed by a single projection. The single projection can be adjustable between different lengths to define flow gaps 58 having different sizes. For example, the single projection can be configured to telescope, can be formed by segments folded together, among other options.

In some examples, the flow inhibitor 60 can be formed as a single projection that can be oriented in different positions to change the size of the flow gap 58. For example, the flow inhibitor 60 can be placed in a first angular position to define a first size flow gap 58 and can be pivoted to a second angular position to define a second size flow gap 58 different from the first size of flow gap 58. The single projection can be fixed in the desired angular position to fix the flow gap 58 at the desired size.

The flow inhibitor 60 can be actuated between a stowed state and a deployed state. The flow inhibitor 60 extends into the flowpath through the flow passage 50 while in the deployed state. The flow inhibitor 60 can be retained out of, or with as little obstruction as possible, while in the stowed state. For example, one or more baffles 84 forming the flow inhibitor 60 can be disposed horizontally or substantially horizontally while in the stowed state. The stowed state is associated with a maximum flow through the flow passage 50.

In the example shown, the flow inhibitor 60 is configured to be actuated between various deployed states to change the size of the flow gap 58. For example, the flow inhibitor 60 can include a short baffle 84*a*, an intermediate baffle 84*b*, and a long baffle 84*c*. The short baffle 84*a* is associated with a largest size of flow gap 58 while the long baffle 84*c* is associated with a smallest size of flow gap 58. The baffles 84 are stacked to provide for simple and easy transition between the various deployed states. The short baffle 84*a* can be deployed while the intermediate baffle 84*b* and long baffle 84*c* remain stowed, such as by being pivoted upwards and connected to flow divider 34 (e.g., by magnetic coupling among other options). The intermediate baffle 84*b* can be deployed while the long baffle 84*c* remains stowed to provide another size of flow gap 58. The long baffle 84*a* can be deployed while the intermediate baffle 84*b* and short baffle 84*a* remain deployed to provide another size of flow gap 58.

In the example shown, the flow divider 34 is configured such that the long baffle 84*c* is an upstream one of baffles 84 and the short baffle 84*a* is a downstream one of baffles 84 within the flow divider 34. Such a configuration allows for serial deployment to set the size of the flow gap 58. The multiple baffles 84 can be placed in a stowed state together and then deployed from shortest to longest to define the flow gap 58.

The flow divider 34 being adjustable to provide different sized flow gaps 58 provides improved cooking efficiency and end product quality. The flow gap 58 can be adjusted based on the particular foodstuff being prepared. In some examples, the size of the flow gap 58 can be set based on a vertical dimension of the foodstuff being prepared. For example, the flow divider 34 can be set to have a relatively smaller flow gap 58 for smaller profile foodstuffs (e.g., ribs, cookies, fish, etc.), the flow divider 34 can be set to have an intermediate size flow gap 58 for medium sized foodstuffs (e.g., whole chicken, some breads, etc.), the flow divider 34 can be set to have a relatively larger size flow gap 58 for larger sized foodstuffs (e.g., pork shoulder, etc.).

The projection of the foodstuff into the flow passage 50 affects the interfacing between the output from the heating chamber 20 and the foodstuff. For example, the relatively smaller size flow gap 58 is utilized for smaller profile items to prevent the output from flowing vertically above and past that foodstuff. The relatively smaller flow gap 58 encourages the output to interact with the foodstuff in the vertically lower portion of the flow passage 50. A relatively larger flow gap 58 can be used for foodstuffs that project further into the flow passage 50 as the output will encounter such vertically projecting foodstuffs as the output flows through the flow passage 50 and as there is less space for the output to flow past and vertically above the foodstuff.

In the example shown, each flow passage 50 is associated with an adjustable flow inhibitor 60. Cooker 10 includes a further flow inhibitor 60 at a downstream end of the heating chamber 20. It is understood that, in various examples, the cooker 10 does not include a flow inhibitor 60 associated with the heating chamber 20.

Cooker 10 provides a continuous flow food preparation device. During operation, the output for preparing the foodstuff can be generated in the heating chamber 20. The output flow (indicated by arrows OF) flows serially through the flow passages 50 and interacts with the foodstuffs supported on racks 46 to prepare the foodstuffs. Flow inhibitors 60 are placed in a desired state for the foodstuff being prepared. For example, the flow inhibitors 60 can be deployed to a desired deployed state or maintained in the stowed state.

It is understood that each flow inhibitor 60 can be individually adjusted such that each flow passage 50 is associated with its own sized flow gap 58. For example, a subset of the flow inhibitors 60 can be placed in a stowed state while another subset of the flow inhibitors 60 are placed in a desired deployed state.

In additional or alternative examples, a subset of the flow inhibitors 60 can be placed in a first deployed state and a second subset of the flow inhibitors 60 can be placed in a second deployed state associated with a different size flow gap 58 than the first deployed state. In some examples, yet another subset of the flow inhibitors 60 can be placed in a third deployed state associated with a different size flow gap 58 than the first deployed state and the second deployed state. The flow inhibitors 60 can be set to define the desired flow gap 58 based on the foodstuff in the flow passage 50 associated with that flow inhibitor 60.

The food preparation output (heat and/or smoke) is provided from heating chamber 20. The output flows through an initial passage bend 52 and around the divider wall 40 to enter into an upstream-most flow passage 50. The output flows through the flow passage 50 and can be restricted by the flow divider 34 of that flow passage 50. The output flows through a passage bend 52 and into a subsequent flow passage 50. The output continues serially through the flow passages 50 and eventually flows through a downstream-most one of the flow passages 50. The output exits from the downstream-most flow passage 50 and is exhausted from the cooker 10 through exhaust 30.

In the example shown, the output flows through a terminal passage bend 52 between the downstream-most flow passage 50 and the exhaust 30. Having a terminal passage bend 52 between the downstream-most flow passage 50 and the exhaust 30 can prevent the output from flowing directly to the exhaust 30 from the flow passage 50. Such a configuration assists in maintaining a desired consistent temperature throughout the cooking chamber 82.

Cooker 10 provides significant advantages. Cook pathway 22 provides a serpentine flowpath that the output flows through between heating chamber 20 and exhaust 30. The serial flow is not blown or forced through the flow passages 50 in this example. Cooker 10 does not include a fan or other mechanical air mover that drives the output through the cook pathway 22. Instead, the output rises through the vertically stacked flow passages 50 and towards the exhaust 30.

Flow dividers 34 separate the flow passages 50 to facilitate the serial flow. In the example shown, the flow dividers 34 are formed by drip pans 36. The drip pans 36 can be snug fit within housing body 16 to form the flow dividers 34. The drip pans 36 are configured to catch any drippings (e.g., grease, fat, etc.) from the foodstuff in the rack 46 directly above the drip pan 36. The drip pans 36 can both catch drippings from the foodstuff and provide the flow dividers 34 that separate the flow passages 50. Such a configuration can reduce part count and provide for a simple and efficient division between flow passages 50.

Flow inhibitors 60 are associated with flow passages 50 and are configured to direct the output flow to provide improved cooking efficiency and finished product quality. Flow inhibitor 60 defines a vertical size of the flow gap 58. The size of the flow gap 58 can be adjusted to direct heat and/or smoke onto the foodstuff, providing for more efficient cooking operation.

Cooker 10 provides for a continuous flow of the output from heating chamber 20 through cook pathway 22 and to exhaust 30. The cooker 10 provides a clear, defined pathway for the output to flow past the foodstuff. For example, cooker 10 provides for improved smoke absorption that results in a rich smoke flavor and the finished product having a desired bark and desired smoke ring.

The serial flow of the output through the vertically stacked flow passages 50 and to the exhaust 30 guides the output flow. Such guided flow provides for consistent temperatures throughout the cooking chamber 82. Such a configuration can eliminate the need for heat probes to determine hot and cold spots within the cooking chamber 82. The even and consistent output throughout the cooking chamber 82 provides a quality and consistent end product.

Figure 3A:
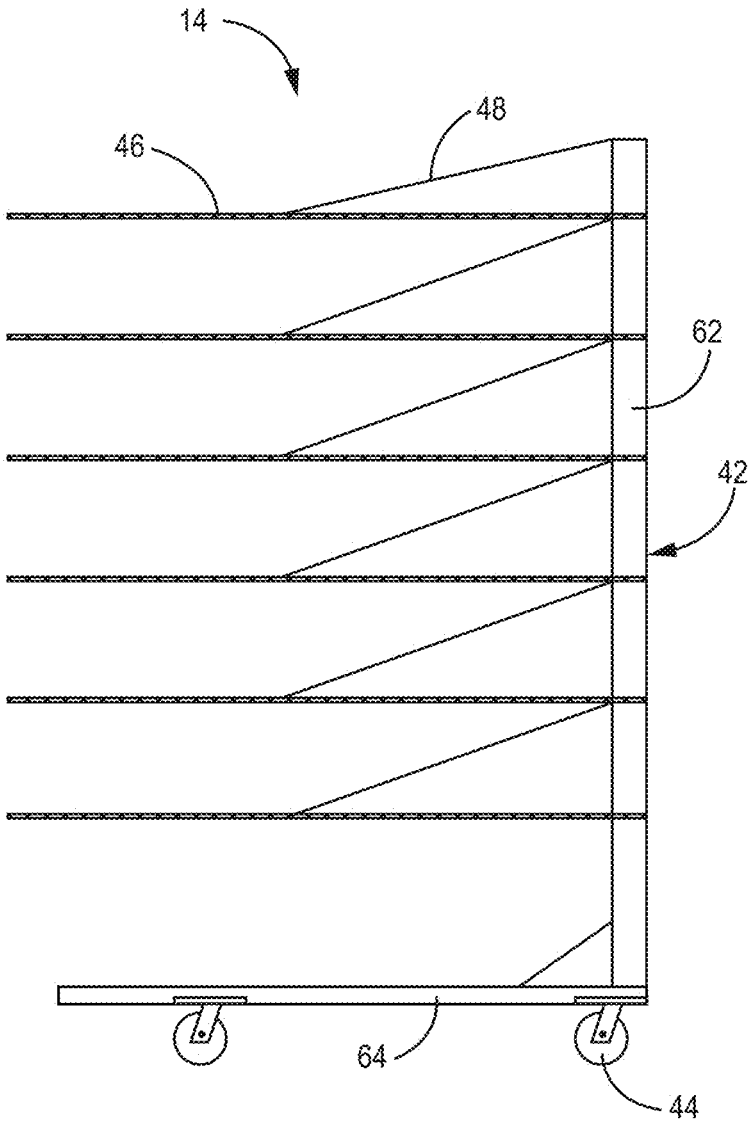
FIG. 3A is a side view of a rack assembly.
Figure 3B:
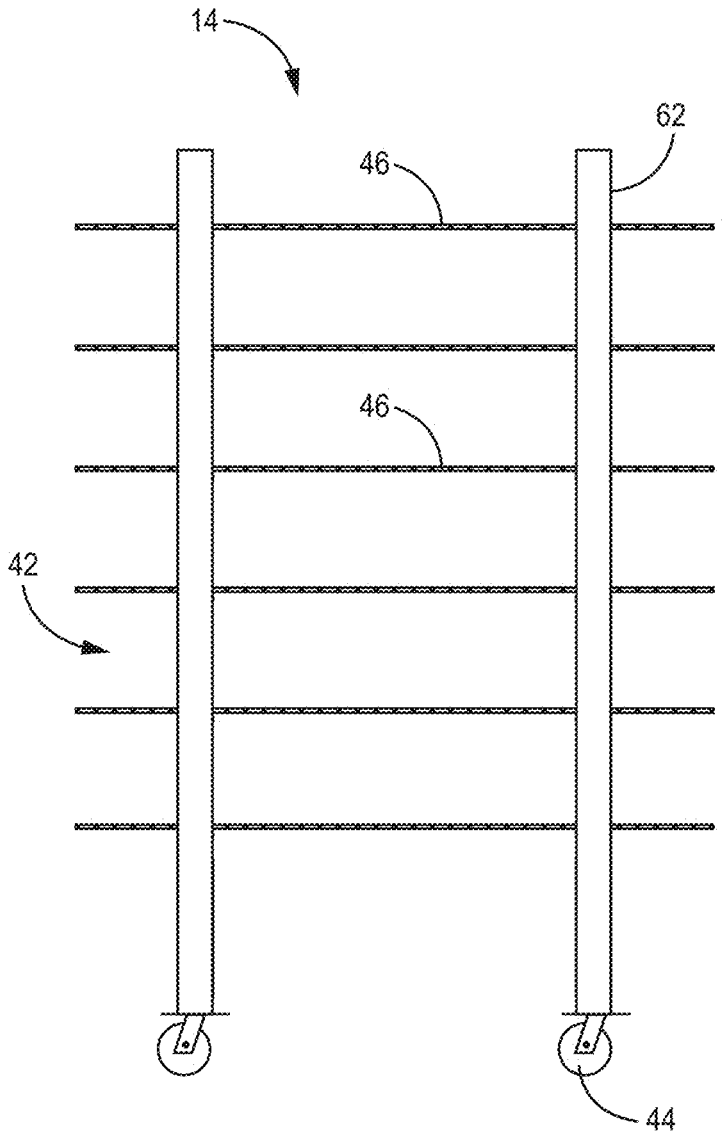
FIG. 3B is an end view of the rack assembly.

FIG. 3A is a side sectional view of rack assembly 14. FIG. 3B is an end view of rack assembly 14. FIGS. 3A and 3B are discussed together. Rack assembly 14 includes assembly frame 42, racks 46, wheels 44, and brackets 48. Assembly frame 42 includes vertical portion 62 and horizontal portion 64. Rack assembly 14 is configured to insert into a cooking chamber 82 and remove from a cooking chamber 82.

Assembly frame 42 supports racks 46. In the example shown, the racks 46 are connected to vertical portion 62 of assembly frame 42. Brackets 48 are connected to racks 46 and to vertical portion 62. It is understood that the grates of the racks 46 can be removable from rack assembly 14, such as for cleaning. For example, the grates can mount on grate supports that are connected to the assembly frame 42 and connected to the brackets 48. Wheels 44 are connected to horizontal portion 64 of assembly frame 42. The multiple racks 46 are stacked vertically. The rack assembly 14 can be inserted into and removed from cook housing 12 by rolling on wheels 44.

In the example shown, cooker 10 is configured such that rack assembly 14, including assembly frame 42, remains within cooker 10 during the cooking process. It is understood, however, that not all examples are so limited. For example, rack assembly 14 can be configured to place racks 46 within cooker 10 and then the assembly frame 42 pulls away and out of the cooker 10. The racks 46 remain within cooker 10 while the assembly frame 42 is removed. The assembly frame 42 can then be used to place additional racks 46 within cooker 10 or to place racks 46 in different ones of cooker 10.

In the example shown, the racks 46 are vertically stacked within cooker 10. It is understood that, in various examples, cooker 10 can be sized such that racks 46 can be stacked longitudinally and/or laterally. For example, cooker 10 can be configured such that racks 46 can be placed in laterally adjacent positions such that a flow passage 50 is defined on its top and/or bottom side by multiple laterally stacked racks 46. In some examples, cooker 10 can be configured such that racks 46 can be placed in longitudinally adjacent positions. In such an examples, a flow passage is defined on its top and/or bottom side by multiple longitudinally stacked racks 46. In the example shown, having multiple longitudinally stacked racks 46 for a single flow passage 50 increases the length of the flow passage 50 between passage bends 52.

Figure 4:
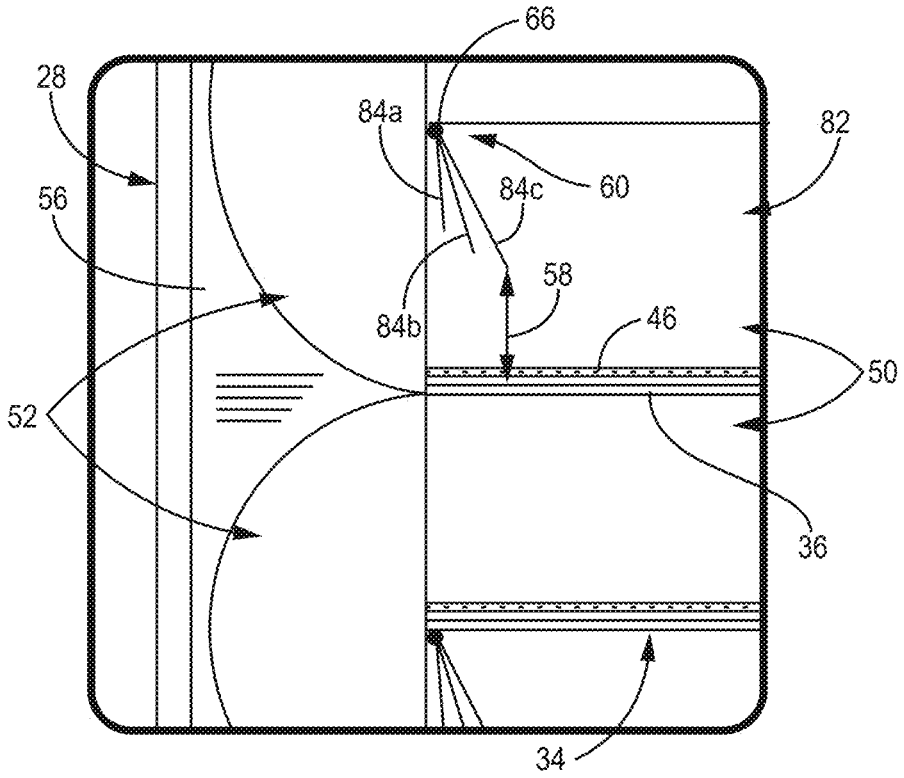
FIG. 4 is an enlarged view of detail 4 in FIG. 3A.

FIG. 4 is an enlarged view of detail 4 in FIG. 2A. Portions of adjacent flow passages 50 and passage bends 52 between the flow passages 50 are shown. Flow divider 34 and flow inhibitor 60 are shown.

Flow dividers 34 are disposed between the vertically stacked flow passages 50. Racks 46 are positioned vertically above the flow dividers 34. Any drippings from the racks 46 can fall onto and be collected by the drip pan 36 forming the flow divider 34.

The foodstuff is disposed in the flow passages 50. Flow inhibitor 60 is configured to project into the flow passage 50 into the output flow through the flow passage 50. Flow inhibitor 60 extends at least partially vertically across the flow passage 50. The flow inhibitor 60 extends transverse to the flow direction through the flow passage 50 associated with the flow inhibitor 60.

The output flow is configured to flow through flow gap 58. The flow gap 58 is defined between the flow inhibitor 60 and the flow divider 34. In the example shown, the flow gap 58 is formed in a lower portion of the flow passage 50. Flow divider 34 extends from a vertically upper side of the flow passage 50. The flow divider 34 blocks an upper portion of the flow passage 50 while the flow gap 58 is formed in a lower portion of the flow passage 50. It is understood that the lower portion of the flow passage 50 can form a majority of a full height of the flow passage 50, the lower portion of the flow passage 50 can form half of the full height of the flow passage 50, or the lower portion of the flow passage 50 can form a minority part of the full height of the flow passage 50.

The flow gap 58 can form a majority of a full height of the flow passage 50, the lower portion of the flow gap 58 can form half of the full height of the flow passage 50, or the lower portion of the flow gap 58 can form a minority part of the full height of the flow passage 50.

Flow inhibitor 60 blocks the upper portion of the flow passage 50. The flow inhibitor 60 extending downward to block the upper portion of the flow passage 50 blocks the output from flowing straight through the flow passage 50 within the upper portion. The output flows around the distal end of the flow inhibitor 60 and exits the flow passage 50 from the lower portion of the flow passage 50. The flow inhibitor 60 can cause the output (e.g., smoke) to have a longer residence time within the flow passage 50. The flow inhibitor 60 can additionally or alternatively cause a denser concentration of the output within the flow passage 50, thereby causing greater contact with the foodstuff. The flow inhibitor 60 can additionally or alternatively cause the output to concentrate at a lower vertical location within the flow passage 50, increasing contact with the foodstuff and providing improved absorption of the output by the foodstuff.

In the example shown, the flow inhibitor 60 includes at least one baffle 84, though it is understood that not all examples are so limited. In this particular example, the flow inhibitor 60 includes a plurality of baffles 84. Flow inhibitor 60 is connected to housing body 16 at pivot point 66. While each of the multiple baffles 84 are shown as connected to a common pivot point 66, it is understood that not all examples are so limited. For example, the multiple baffles 84 can be connected at multiple pivot points 66.

Flow inhibitor 60 is movable between a stowed state and a deployed state. In the example shown, the flow inhibitor 60 is movable between a stowed state and a plurality of deployed states. Flow inhibitor 60 can be connected to a flow divider 34 while in the stowed state. For example, the flow inhibitor 60 can be connected to the flow divider 34 disposed above the flow passage 50 associated with the flow inhibitor 60. The flow inhibitor 60 can be connected to the flow divider 34 by a magnetic connection, latch, interference fit, among other options. In some examples, the baffles 84 forming the flow inhibitor 60 can be stacked while in the stowed state. The baffles 84 can be connected to the flow divider 34 while in the stowed state. For example, long baffle 84*c* can connect to the flow divider 34, intermediate baffle 84*b* can connect to long baffle 84*c*, and short baffle 84*a* can connect to intermediate baffle 84*b*.

Figure 5A:
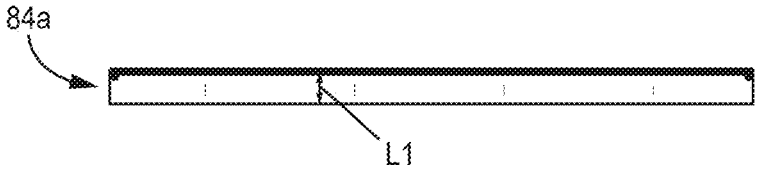
FIG. 5A is a plan view of a baffle.
Figure 5B:
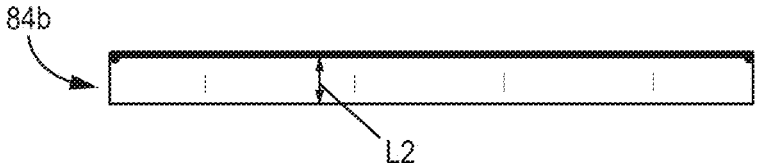
FIG. 5B is a plan view of a baffle.
Figure 5C:
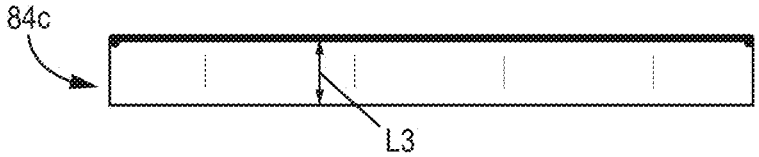
FIG. 5C is a plan view of a baffle.

FIG. 5A is a plan view of a short baffle 84*a*. FIG. 5B is a plan view of an intermediate baffle 84. FIG. 5C is a plan view of a long baffle 84*c*. FIGS. 5A-5C are discussed together. Baffles 84 are configured to deploy to define a size of the flow gap 58. Baffles 84*a*-84*c* together define a flow inhibitor 60 of the cooker 10. Long baffle 84*c* has length L1, intermediate baffle 84*b* has length L2, and short baffle 84*a* has length L3. Length L1 is larger than length L2. Length L2 is larger than length L3. The different length baffles 84 facilitate converting the flow inhibitor 60 between different deployed states corresponding to different sizes of the flow gap 58.

Figure 6:
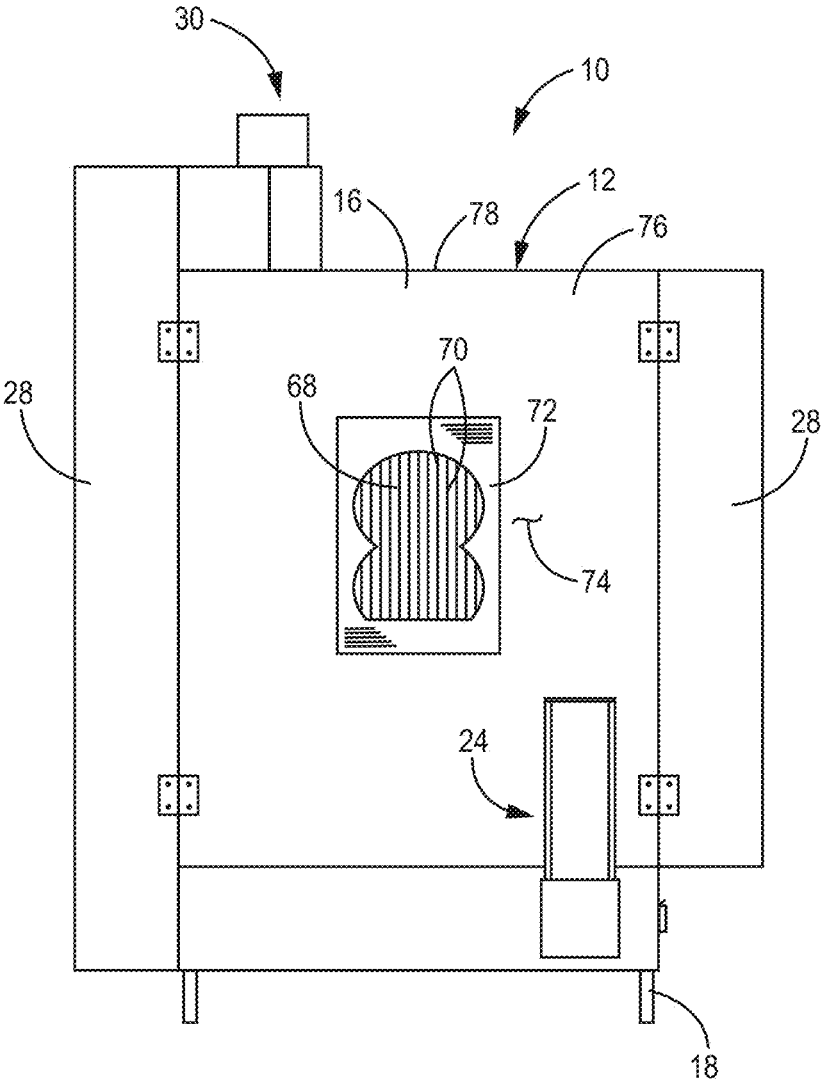
FIG. 6 is a side cutaway view of a cooker.

FIG. 6 is a partial cut-away side view of cooker 10. Portions of housing body 16 are shown. Cook housing 12 includes housing body 16 and housing doors 28. Housing body 16 includes interior skin 68, heating cables 70, insulating layer 72, and exterior skin 74. Heating cables 70 are disposed between interior skin 68 and insulating layer 72 in the example shown.

Heating cables 70 are configured to generate heat to heat the cooking chamber 82. For example, heating cables 70 can be formed as resistive heating wires. Heating cables 70 can be configured to generate heat based on electric current flow through heating cables 70.

In some examples, housing body 16 includes a pair of side walls 76 that extend vertically from divider wall 40. Side walls 76 are formed on the lateral sides of the housing body 16. Side walls 76 form lateral walls of the housing body 16 in this example. Each of side walls 76 and divider wall 40 can include the interior skin 68, exterior skin 74, insulating layer 72, and heating cables 70.

In various examples, the housing body 16 can wrap at least partially around the cooking chamber 82. The housing body 16 can wrap around two vertically extending sides and a side that connects between the two vertically extending sides. The side that connects between the two vertically extending sides can be disposed vertically below the cooking chamber 82. The side that connects between the two vertically extending sides can be formed by the divider wall 40. The housing body 16 includes a top side 78 that connects between the two side walls 76.

The heating cables 70 can wrap at partially around the cooking chamber 82. Heating cables 70 can be disposed in one or both side walls 76. Heating cables 70 can be disposed in divider wall 40. Heating cables 70 can extend from within one side wall 76, through divider wall 40, and into the other side wall 76. In some examples, the heating cables 70 can extend fully around the cooking chamber 82, such as by extending within top side 78, side walls 76, and divider wall 40. The heating cables 70 can wrap arcuately around the cooking chamber 82. In some examples, the heating cables 70 can be disposed in a U-shaped configuration that extends partially around the cooking chamber 82.

Interior skin 68 can be formed from a thermally conductive material. For example, interior skin 68 can be formed from metal. Heating cables 70 are disposed between insulating layer 72 and interior skin 68 in this example. The insulating layer 72 assists in retaining the heat generated by heating cables 70 to direct the heat towards the cooking chamber 82. The heating cables 70 are configured to generate heat that is transferred through interior skin 68 to the cooking chamber 82.

Heating cables 70 can be set, such as by a controller 80 having control circuitry and computer readable memory, to operate based on a target temperature within cooking chamber 82. It is understood that heating cables 70 can be operated based on the target maintenance temperature even while an output is being generated in the heating chamber 20. The target maintenance temperature can vary from a target internal temperature associated with the output from heating chamber 20.

In one example, the heating cables 70 can be controlled by the controller 80 based on a sensed internal temperature within the cooking chamber 82. For example, the output from the heating chamber 20 can be at a higher temperature than the target maintenance temperature associated with the heating cables 70. The heating cables 70 can generate heat based on the actual internal temperature falling to, falling below, or coming within a threshold value (e.g., 1-degrees, 5-degrees, etc.) of the target maintenance temperature. In such an example, the heating cables 70 can maintain the internal temperature at a desired level after preparing the foodstuff with the output from the heating chamber 20.

It is understood that cooker 10 can be utilized for food preparation based on thermal input from the heating cables 70 without the output from the heating chamber 20. For example, the cooker 10 can be utilized as a traditional oven, such as to prepare baked goods among other foodstuffs. The cooker 10 can be utilized to hold a temperature within the cooking chamber 82. The cooker 10 can be utilized as a cook-and-hold style cooker in which the foodstuff is cooked and then held at a lower temperature than the cooking temperature. The cooker 10 can be utilized as a heat-and-hold style cooker utilized to heat foodstuffs and hold the foodstuffs at a desired temperature.

Cooker 10 can provide an all-in-one start-to-finish food preparation device. For example, while smoking various foodstuffs (e.g., meats) the smoking portion of the preparation process, utilizing smoke output from heating chamber 20, is a first portion of the preparation process, while resting and/or holding the foodstuff at a desired temperature is a second portion of the process. Cooker 10 can both prepare the foodstuffs via the output from the heating chamber 20 and hold the foodstuff at a desired temperature via the heat output by heating cables 70.

Figure 7:
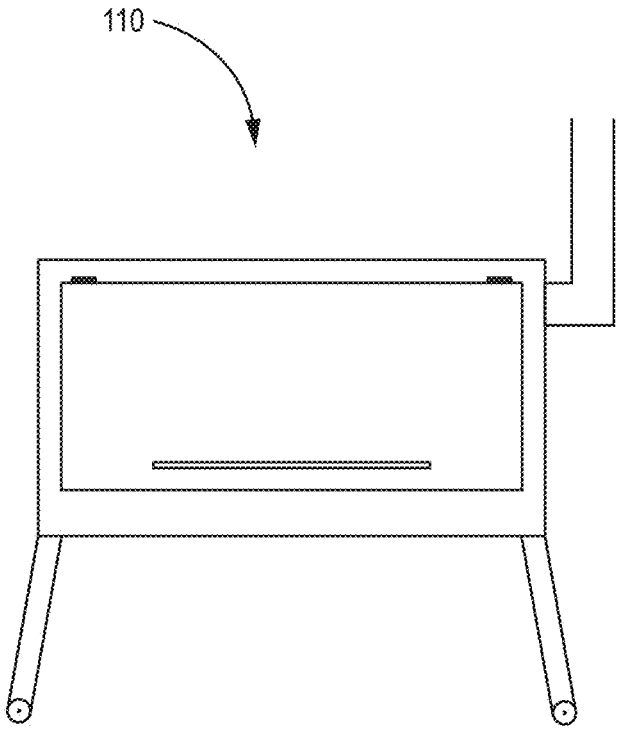
FIG. 7 is a front view of a cooker.
Figure 8:
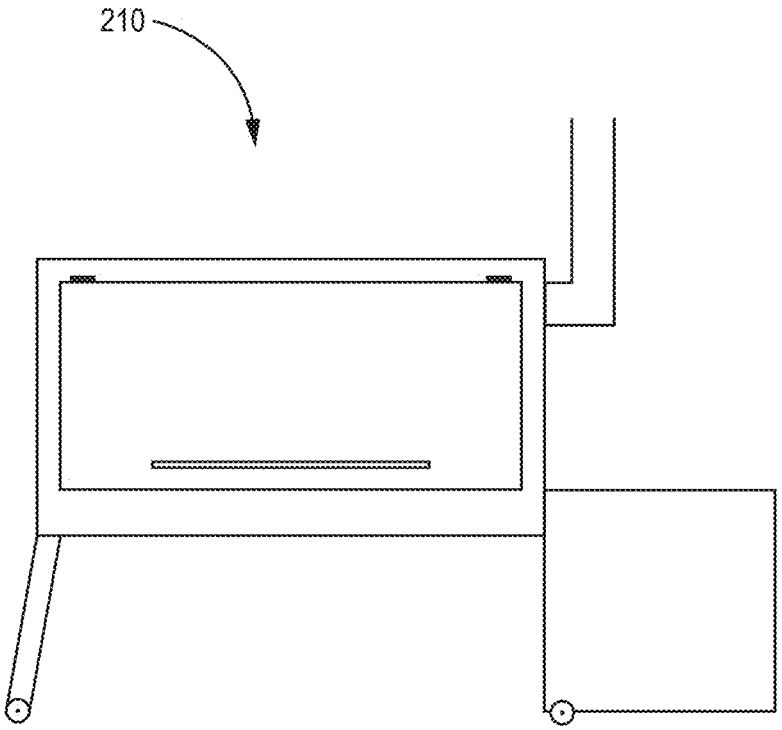
FIG. 8 is a front view of a cooker.
Figure 9:
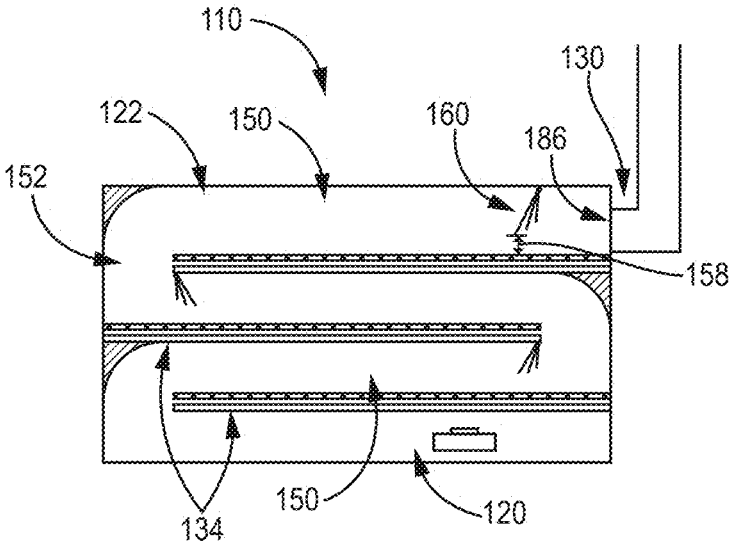
FIG. 9 is a cross-sectional view taken along line 8-8 in FIG. 6.

FIG. 7 is a front view of cooker 110. FIG. 8 is a front view of cooker 210. FIG. 9 is a cross-sectional view taken along line 9-9 in FIG. 7. FIGS. 7-9 are discussed together. Cooker 110 is substantially similar to cooker 10 (best seen in FIGS. 1A-2B), except that cooker 110 does not include a removable rack assembly 14. Cooker 210 is substantially similar to cooker 10, except that cooker 210 does not include a removable rack assembly 14 in this example. It is understood, however, that not all examples are so limited. Further, the individual racks 146 can be removable in various examples. Cooker 210 is substantially similar to cooker 110, except that cooker 210 is configured as in an offset configuration whereas cooker 110 has a heating chamber 120 disposed directly vertically under the flow passages 150. Elements of cooker 110 similar to or the same as elements of cooker 10 are labeled with the same reference number except increased by "100" (e.g., flow passage 150 of cooker 110 and flow passage 50 of cooker 10). Elements of cooker 210 similar to or the same as elements of cooker 10 are labeled with the same reference number except increased by "200" (e.g., flow passage 250 of cooker 210 and flow passage 50 of cooker 10).

Cooker 110 and cooker 210 are substantially similar except that cooker 110 is configured with a vertically aligned heating chamber 120 whereas cooker 210 is configured with an offset heating chamber 220. The heating chamber 220 of cooker 210 is not vertically aligned with flow chambers 250.

While FIG. 9 is a cross-section of cooker 110, it is understood that FIG. 9 is representative of cooker 210. In the example shown, flow dividers 134 are offset from each other. It is understood that cookers of the current disclosure can include flow dividers 134 that are offset laterally or longitudinally. The offset in the present example facilitates formation of the passage bends 152 that direct the output vertically upward between adjacent flow passages 150.

Exhaust 130 is disposed at a downstream end of a downstream-most flow passage 150 of the cooking pathway 122. In the example shown, the exhaust 130 opens into a lower portion of the flow passage 150. A vertically upper end of the exhaust opening 186 into the flow passage 150 is spaced vertically downward from the upper side of the flow passage 150. The exhaust opening 186 being disposed in a lower portion of the flow passage 150 directs the flow of the output from heating chamber 120 vertically lower to enter into exhaust 130.

The exhaust opening 186 can overlap with the flow inhibitor 160 along the flow direction with the flow inhibitor 160 in the deployed state. In various examples, a lower portion of the exhaust opening 186 can be disposed vertically below a distal end of the flow inhibitor 160 with the flow inhibitor in a fully deployed state in which the flow gap 158 is at a smallest size. Such a configuration encourages flow onto and around the foodstuffs as the flow moves through that downstream-most flow passage 150 and to the exhaust 130.

Figure 10:
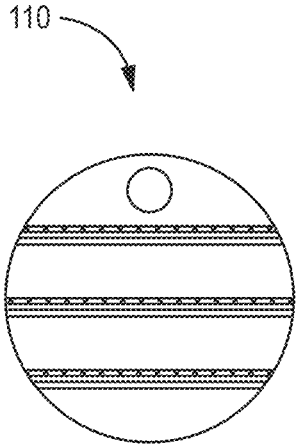
FIG. 10 is a cross-sectional end view of a cooker.

FIG. 10 is a cross-sectional end view of a cooker 110. In the example shown, the cooker has a circular cross-section when viewed in the flow direction.

Figure 11:
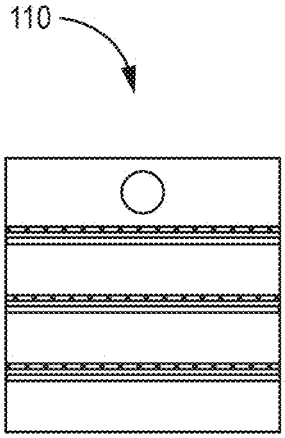
FIG. 11 is a cross-sectional end view of a cooker.

FIG. 11 is a cross-sectional end view of a cooker 110. In the example shown, the cooker has a rectangular cross-section when viewed in the flow direction. The cooker 110 can have a square-cross-section in various examples.

Figure 12:
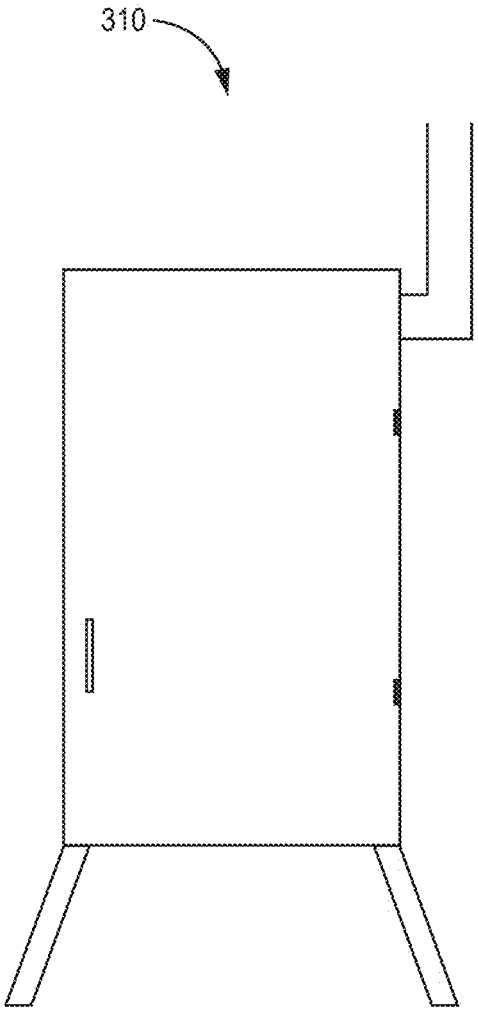
FIG. 12 is a front view of a cooker.
Figure 13:
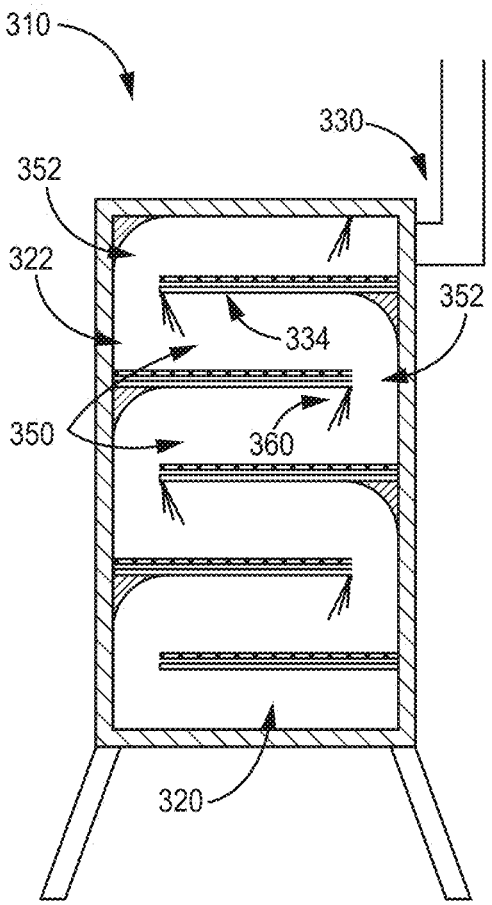
FIG. 13 is a cross-sectional view of the cooker shown in FIG. 12.

FIG. 12 is a front view of a cooker 310. FIG. 13 is a cross-sectional view of the cooker 310 shown in FIG. 12. FIGS. 12 and 13 are discussed together. Cooker 310 is substantially similar to cooker 10 (best seen in FIGS. 1A-2B), except that cooker 310 does not include a removable rack assembly 14. Cooker 310 is substantially similar to cooker 110 (FIG. 7) and cooker 210 (FIG. 8) except that cooker 310 is vertically elongate. Elements of cooker 310 similar to or the same as elements of cooker 10 are labeled with the same reference number except increased by "300" (e.g., flow passage 150 of cooker 110 and flow passage 50 of cooker 10). Heating chamber 320, cooking pathway 322, exhaust 330, flow dividers 334, flow passages 350, passage bends 352, and flow inhibitors 360 of cooker 310 are shown.

Cooker 10 shown in FIGS. 1A-4 is configured as an industrial style cooker. Cookers 110, 210, 310 shown in FIGS. 7-13 are configured as at-home style cookers that do not include a removable rack assembly 14. It is understood that the aspects discussed with regard to cooker 10 are equally applicable to cooker 110, 210, 310. For example, the individual racks and flow dividers (e.g., as formed by drip pans) can be removable within cookers 110, 210, 310 similar to cooker 10; cookers 110, 210, 310 can include a housing body formed with internal heating cables; etc.

Figure 14:
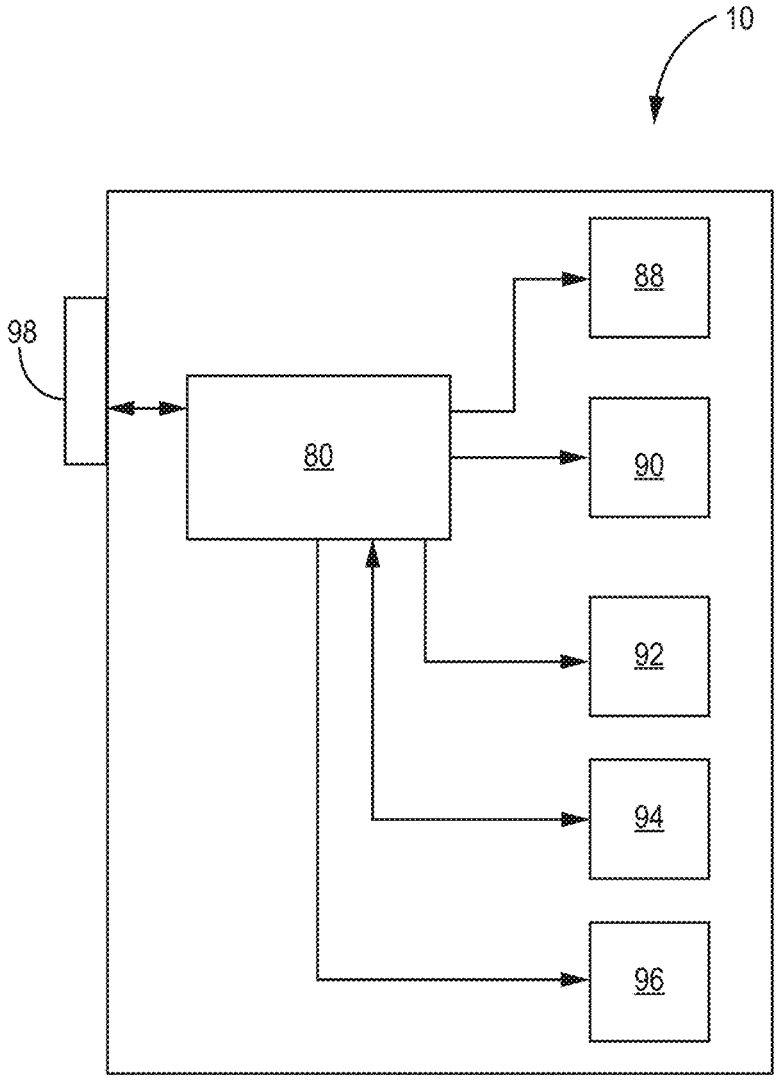
FIG. 14 is a block diagram of a cooker.

FIG. 14 is a block diagram showing cooker 10. Controller 80, flow adjustor 88, feed control 90, inhibitor adjustor 92, sensors 94, heater 96, and user interface 98 of cooker 10 are shown. Controls aspects of cooker 10 are discussed with regard to FIG. 14. It is understood that while cooker 10 is discussed, the following discussion regarding the controls aspects apply equally to any example of a cooker discussed herein (e.g., cooker 110, 210, 310).

Controller 80 is operably connected to components of cooker 10, electrically or communicatively, to control operation of cooker 10. Controller 80 can be of any desired configuration for controlling operation of cooker 10 and can include control circuitry (e.g., one or more of a processor, a microprocessor, a controller, a digital signal processor (DSP), an application specific integrated circuit (ASIC), a field-programmable gate array (FPGA), a graphics processing unit (GPU), a system-on-module (SOM), or other equivalent discrete or integrated logic circuitry) and computer-readable memory.

Controller 80 is configured to store executable code, implement functionality, and/or process instructions. Controller 80 is configured to perform any of the functions discussed herein, including controlling operation of any components referenced herein. Controller 80 can be of any suitable configuration for controlling operation of cooker 10, gathering data, processing data, etc. Controller 80 can include hardware, firmware, and/or stored software. Controller 80 can be of any type suitable for operating in accordance with the techniques described herein. While controller 80 is illustrated as a single unit, it is understood that controller 80 can be entirely or partially mounted on one or more circuit boards. In some examples, controller 80 can be implemented as a plurality of discrete circuitry subassemblies.

Flow adjustor 88 is operatively connected to air intakes 38. Flow adjustor 88 is configured to actuate air intakes 38 based on commands from controller 80. For example, flow adjustor 88 can be configured to cause air intakes 38 to increase flow by increasing the area for flow into heating chamber 20 by reducing the area for flow into heating chamber 20. The flow adjustor 88 can be configured to cause the air intakes 38 to adjust further open or closed. Flow adjustor 88 can be configured as a motor or other actuator (e.g., linear actuator, rotational actuator, etc.) suitable for varying a size of the openings through air intakes 38.

Feed control 90 is operatively connected to fuel source 24. Feed control 90 can control fuel flow to the heating chamber 20 (and/or output generator 25). For example, feed control 90 can be operably associated with a hopper and can actively drive material (e.g., wood pellets among other options) from the hopper to the heating chamber 20. Feed control 90 is operably connected to controller 80 and can control the feed of the fuel based on commands from controller 80. Feed control 90 can be configured as or include, a regulating valve (e.g., for controlling gas flow), an auger (e.g., for displacing material), an electric motor, among other options.

Inhibitor adjustor 92 is operably connected to one or more flow inhibitors 60. In some examples, each flow inhibitor 60 can include a dedicated inhibitor adjustor 92 such that the flow inhibitors 60 are individually actuatable. Inhibitor adjustor 92 is configured to displace the flow inhibitor 60 to adjust a size of the flow gap 58 between the flow inhibitor 60 and the base of the flow passage. For example, inhibitor adjustor 92 can be configured to deploy or retrieve baffles 84 to adjust the size of the flow gap 58. Inhibitor adjustor 92 can be configured as or include an electric motor, among other options. In some examples, inhibitor adjustor 92 can be configured to dynamically adjust the flow gap 58 during the cooking process, such as based on commands received from controller 80.

Sensors 94 are configured to generate information regarding parameters within cooker 10. Sensors 94 can be operatively connected to controller 80 to provide parameter information to controller 80. It is understood that sensors 94 can be formed by one or more sensors that can be configured to generate information regarding the same or different parameter. One or more of the sensors 94 can be configured to generate temperature information regarding the temperature within cooker 10. One or more of sensors 94 can be configured as a temperature probe, such as to be inserted into the foodstuff being prepared to provide information regarding the internal temperature of the foodstuff. One or more of sensors 94 can be configured as a flow sensor configured to generate information regarding the flowrate of the output through the cook pathway 22.

Heater 96 is operatively connected to controller 80. Heater 96 is controllable by the controller 80 to control an output temperature of the heater 96 to a target temperature. Heater 96 includes heating cables 70.

User interface 98 can be any graphical and/or mechanical interface that enables user interaction with controller 80. For example, user interface 98 can implement a graphical user interface displayed at a display device of user interface 98 for presenting information to and/or receiving input from a user. User interface 98 can include graphical navigation and control elements, such as graphical buttons or other graphical control elements presented at the display device. User interface 98, in some examples, includes physical navigation and control elements, such as physically-actuated buttons or other physical navigation and control elements. In general, user interface 98 can include any input and/or output devices and control elements that enable user interaction with controller 80. In some examples, user interface 98 can be integrated into cooker 10. For example, user interface 98 can be formed on cook housing 12 for easy user access. In some examples, user interface 98 can be remote from cooker 10 and communicatively connected to controller 80. User interface 98 can communicate with controller 80 via wired or wireless communications. For example, user interface 98 can be a remote computing device that communicates with controller 80, such as a smartphone or tablet, among other options. During operation, controller 80 can provide commands to various components of cooker 10 to facilitate the cooking process. Controller 80 can control operation of other components of cooker 10 based on information received from sensors 94. For example, controller 80 can cause the flow adjustor 88 to open the air intakes 38 to a greater degree to increase flow and thus the temperature within cooker 10, such as based on information from sensors 94 indicating a lower than desired temperature.

Figure 15A:
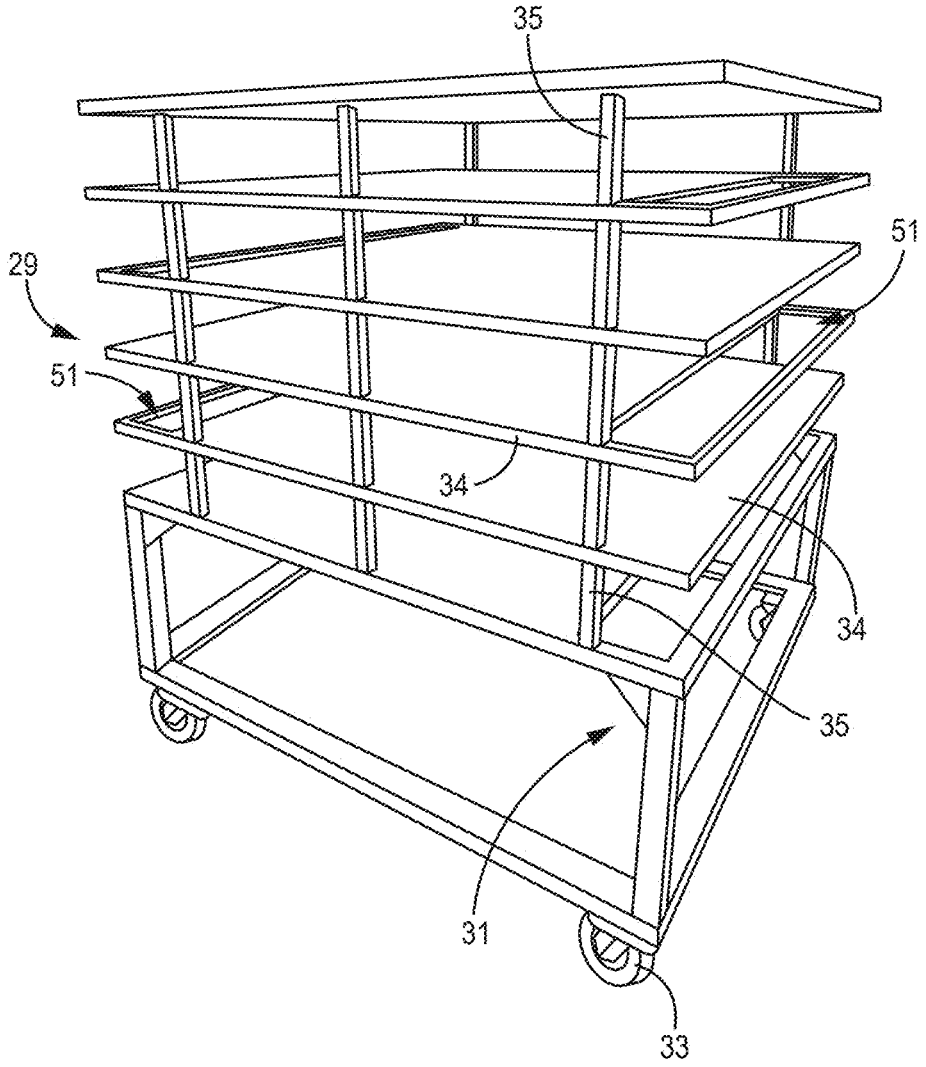
FIG. 15A is an isometric view showing a passage cart for a cooker.
Figure 15B:
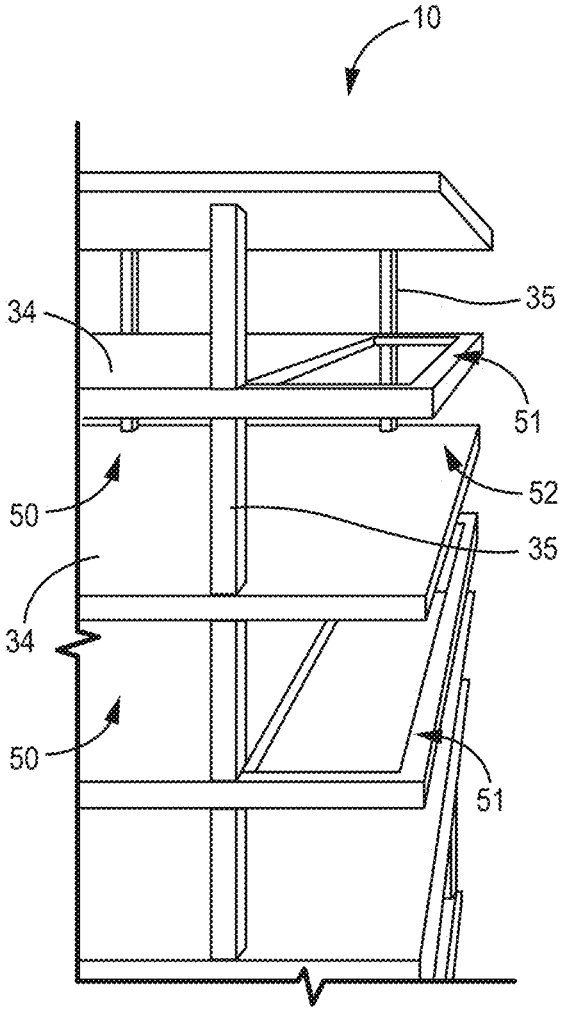
FIG. 15B is an enlarged view showing a portion of FIG. 15A.

FIG. 15A is an isometric view of a passage cart 29 for use in a cooker 10. FIG. 15B is an isometric view showing a portion of the passage cart 29. The passage cart 29 can be insertable into and removable from a body of a cooker 10, such as cook housing 12. In the example shown, flow openings 51 that facilitate flow between adjacent flow passages 50 are formed through the flow dividers 34. It is understood that, while passage bends 52 are shown as formed in housing doors 28 in FIGS. 2A and 2B, such passage bends 52 can be formed through the flow dividers 34 as shown in passage cart 29. In such an example, the housing doors 28 can have flat interior surfaces that can abut the ends of the flow dividers 34.

Flow dividers 34 are shown with flow passages 50 defined therebetween. A housing body 16 is not shown in FIGS. 15A and 15B to clearly show internal components. Flow openings 51 are shown as formed through the flow dividers 34. The flow openings form a portion of a passage bend 52 between adjacent flow passages 50. In the example shown, legs 35 extend between and support flow dividers 34 relative to each other. The legs 35 can be disposed in the flow passages 50. Each flow divider 34 can extend laterally and/or longitudinally outward of the legs 35.

Flow dividers 34 separate the flow passages 50 to cause the output from the heating chamber 20 to flow serially through the flow passages 50. In the example shown, the flow openings 51 are formed through the flow dividers 34. The flow openings 51 can be on opposite ends of vertically adjacent ones of the flow dividers 34 to cause the serpentine flow through the cook pathway 22.

In the example shown, the flow dividers 34 are formed as plates that divide the flow passages 50. The flow dividers 34 do not include and are not formed as integrated drip pans, though it is understood that not all examples are so limited. A drip pan and associated rack can be placed within a flow passage 50 and can, in some examples, be placed on and supported by a flow divider 34.

Passage cart 29 includes frame 31 that supports other components of passage cart 29. Wheels 33 are connected to a bottom end of frame 31. Wheels 33 can be formed as caster wheels, among other options. Legs 35 form portions of frame 31 disposed vertically between and supporting the flow dividers 34. Heating chamber 20 is disposed vertically below the flow dividers 34. Passage cart 29 can be moved into and out of a cooker 10. The passage cart 29 can be wheeled between locations within a food processing facility for the cooking process, such as between a smoke room, a heating room, a packaging area, etc.

Figure 16:
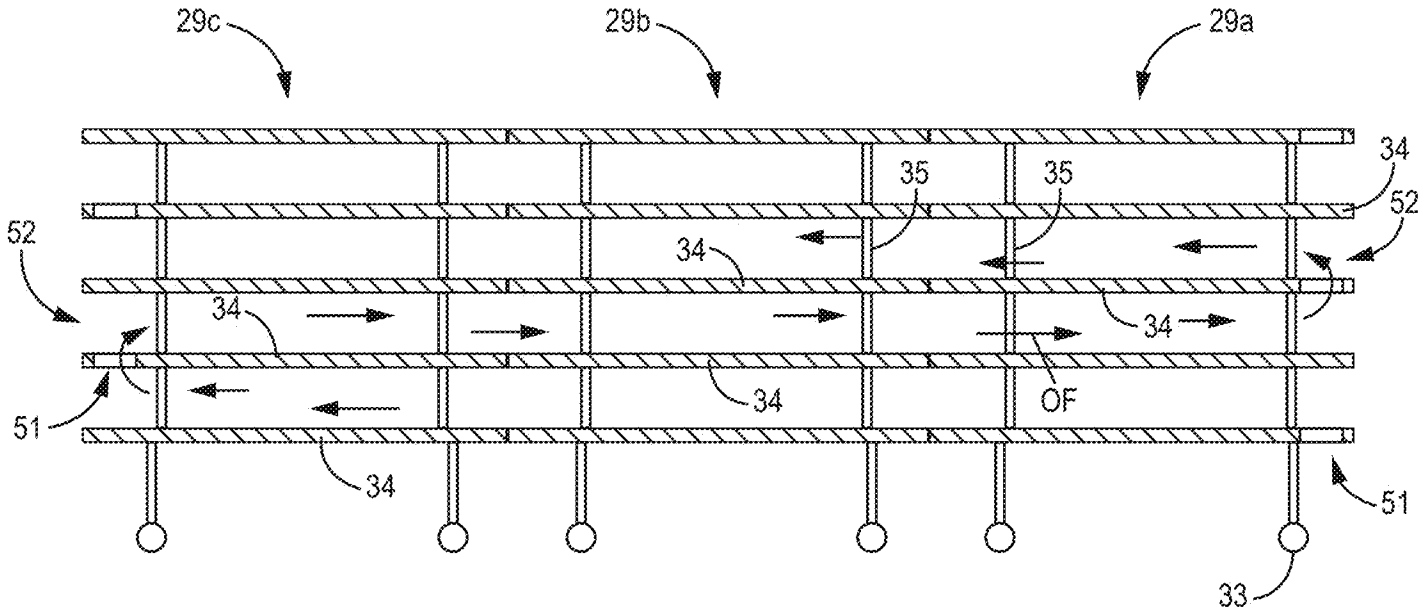
FIG. 16 is a side cross-sectional view of a cooker.

FIG. 16 is a side view showing a cooker 10 including multiple passage carts 29 having different configurations. Cooker 10 can be configured to receive multiple of the passage carts 29 for larger scale food preparation. For example, multiple passage carts 29 can be formed in different configurations and can be aligned relative to each other to form the cook passages 50. In the example shown, passage cart 29*a* is formed in a first configuration, passage cart 29*b* is formed in a second configuration, and passage cart 29*c* is formed in a third configuration. Passage cart 29*a* and passage cart 29*c* include flow openings 51 while the flow dividers 34 of passage cart 29*b* are solid and do not include flow openings 51. The flow openings 51 in passage cart 29*a* alternate with the flow openings 51 in passage cart 29*c* to provide the serial flow through the multiple flow passages 50. Passage cart 29*b* can be considered to form an intermediate passage cart while passage cart 29*a* and passage cart 29*c* can be considered to from end passage carts. The output flow (indicated with arrows OF) is shown between flow passages 50.

Passage cart 29*a* is disposed at one end of the flow passages 50 and includes flow openings 51 through some, but not all, of the flow dividers 34 of passage cart 29*a*. Passage cart 29*c* is disposed at an opposite end of the flow passages 50 from passage cart 29*a* and includes flow openings 51 through some, but not all, of the flow dividers 34 of passage cart 29*c*. Passage cart 29*b* is disposed between passage cart 29*a* and passage cart 29*c* and does not include flow openings 51. While passage cart 29*b* is shown between passage cart 29*a* and passage cart 29*c* it is understood that not all examples are so limited. For example, passage cart 29*a* and passage cart 29*c* can be disposed adjacent to one another without an intermediate passage cart 29*b*. In various other examples, a cooker can include multiple passage carts 29*b* (e.g., two, three, four, five, or more) between the end passage carts 29*a*, 29*c*.

Having multiple passage carts 29 of different configurations can provide significant advantages. The individual passage carts 29 can be inserted and removed at different times to allow for continuous cooking. An individual passage cart 29 can be removed and moved to another location in a facility for additional processing while another passage cart 29 of the same configuration can then be inserted into the cooker to maintain the flow passages 50 and for cooking of new foodstuffs on that inserted passage cart 29.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cooker configured to prepare a foodstuff, the cooker comprising:

a cooker housing defining a cooking chamber;

a cooker passage extending within the cooker housing and configured to convey an output from a heating chamber to an exhaust, the cooker passage including a plurality of flow passages, wherein a first flow passage of the plurality of flow passages is disposed vertically below a second flow passage of the plurality of flow passages, and the heating chamber is disposed vertically below the first flow passage;

a plurality of racks disposed within the cooker housing within the plurality of flow passages; and a flow inhibitor extending at least partially across a vertical extent of at least one flow passage of the plurality of flow passages, and wherein a first rack of the plurality of racks is disposed in the at least one flow passage;

wherein the cooker passage is a serpentine passage that extends from the heating chamber to the first flow passage, then to the second flow passage, and then to the exhaust.

2. The cooker of claim 1, wherein a flow direction of the output from the heating chamber is in a first direction within the first flow passage and is in a second direction within the second flow passage, the second direction opposite the first direction.

3. The cooker of claim 2, wherein a path bend extends between and fluidly connects the first flow passage and the second flow passage, the path bend extending at least partially vertically.

4. The cooker of claim 3, wherein the path bend is a 180-degree bend.

5. The cooker of claim 3, wherein the path bend includes at least one curved surface.

6. The cooker of claim 5, wherein the at least one curved surface includes a first curved surface and a second curved surface spaced vertically from the first curved surface.

7. The cooker of claim 2, wherein the cooker housing includes a housing body and a housing door, and wherein the path bend is formed in the housing door.

8. The cooker of claim 1, further comprising:

a first flow divider disposed vertically between the first flow passage and the second flow passage;

a third flow passage of the cooking pathway disposed vertically above the second flow passage;

a third rack of the plurality of racks disposed in the third flow passage; and a second flow divider disposed in the cooker housing vertically between the second flow passage and the third flow passage.

9. The cooker of claim 1, wherein the flow inhibitor is a first flow inhibitor configured to extend across a portion of a vertical extent of the first flow passage.

10. The cooker of claim 1, wherein the flow inhibitor is movable between a deployed state and a stowed state.

11. The cooker of claim 10, wherein the flow inhibitor is configured to pivot between the stowed state and the deployed state.

12. The cooker of claim 1, wherein the flow inhibitor includes at least one baffle.

13. The cooker of claim 1, wherein the cooker housing includes a housing body and a housing door connected to the housing body, and wherein the housing body includes an interior skin exposed to the cooking chamber, a plurality of heating cables, an insulating layer, and an exterior skin.

14. A cooker configured to prepare a foodstuff, the cooker comprising:

a cooker housing defining a cooking chamber;

a first flow divider disposed within the cooker housing;

a cooker passage extending within the cooker housing and configured to convey an output from a heating chamber to an exhaust, the cooker passage including a plurality of flow passages, wherein a first flow passage of the plurality of flow passages is disposed vertically below a second flow passage of the plurality of flow passages, and the heating chamber is disposed vertically below the first flow passage;

a plurality of racks disposed within the cooker housing, wherein a first rack of the plurality of racks is disposed in the first flow passage and a second rack of the plurality of racks is disposed in the second flow passage;

a first flow inhibitor configured to extend across a portion of a vertical extent of one of the first flow passage and the second flow passage;

wherein the cooker passage is a serpentine passage that extends from the heating chamber to the first flow passage, then to the second flow passage, and then to the exhaust, wherein the first flow inhibitor is movable between a deployed state and a stowed state; and wherein the first flow inhibitor is movable between the stowed state and a plurality of the deployed states.

15. The cooker of claim 14, wherein the first flow inhibitor is configured to pivot between the plurality of deployed states.

16. A cooker configured to prepare a foodstuff, the cooker comprising:

a cooker housing defining a cooking chamber;

a first flow divider disposed within the cooker housing;

a cooker passage extending within the cooker housing and configured to convey an output from a heating chamber to an exhaust, the cooker passage including a plurality of flow passages, wherein a first flow passage of the plurality of flow passages is disposed vertically below a second flow passage of the plurality of flow passages, and the heating chamber is disposed vertically below the first flow passage;

a plurality of racks disposed within the cooker housing, wherein a first rack of the plurality of racks is disposed in the first flow passage and a second rack of the plurality of racks is disposed in the second flow passage;

a first flow inhibitor configured to extend across a portion of a vertical extent of one of the first flow passage and the second flow passage;

wherein the cooker passage is a serpentine passage that extends from the heating chamber to the first flow passage, then to the second flow passage, and then to the exhaust; and wherein the first flow inhibitor defines an outlet gap, the first flow inhibitor is actuatable between a plurality of deployed states, and a size of the outlet gap varies between each deployed state of the plurality of deployed states.

17. The cooker of claim 16, wherein the first flow inhibitor has a first length in a first deployed state of the plurality of deployed states, the first flow inhibitor has a second length in a second deployed state of the plurality of deployed states, and the first length is less than the second length.

18. A cooker configured to prepare a foodstuff, the cooker comprising:

a cooker housing defining a cooking chamber;

a first flow divider disposed within the cooker housing;

a cooker passage extending within the cooker housing and configured to convey an output from a heating chamber to an exhaust, the cooker passage including a plurality of flow passages, wherein a first flow passage of the plurality of flow passages is disposed vertically below a second flow passage of the plurality of flow passages, and the heating chamber is disposed vertically below the first flow passage;

a plurality of racks disposed within the cooker housing, wherein a first rack of the plurality of racks is disposed in the first flow passage and a second rack of the plurality of racks is disposed in the second flow passage;

a first flow inhibitor configured to extend across a portion of a vertical extent of one of the first flow passage and the second flow passage;

wherein the cooker passage is a serpentine passage that extends from the heating chamber to the first flow passage, then to the second flow passage, and then to the exhaust; and wherein the first flow inhibitor includes at least one baffle, and wherein the at least one baffle includes a first baffle having a first length and a second baffle having a second length, the second length greater than the first length.

19. The cooker of claim 18, wherein the at least one baffle includes a third baffle having a third length, the third length greater than the second length.

20. A cooker configured to prepare a foodstuff, the cooker comprising:

a cooker housing defining a cooking chamber;

a first flow divider disposed within the cooker housing;

a second flow divider disposed within the cooker housing;

a first flow passage at least partially defined by the first flow divider;

a second flow passage at least partially defined by the second flow divider;

a heating chamber configured to generate an output that flows through the first flow passage to prepare the foodstuff within the first flow passage, the heating chamber disposed vertically below the first flow passage;

a first rack disposed within the cooker housing and at least partially within the first flow passage and a second rack disposed at least partially within the second flow passage;

a first flow inhibitor disposed at a downstream end of the first flow passage and extending at least partially across a vertical extent of the first flow passage, the first flow inhibitor configured to at least partially block the first flow passage to direct flow of the output from the first flow passage; and a second flow inhibitor disposed at a downstream end of the second flow passage and extending at least partially across a vertical extent of the second flow passage, the second flow inhibitor configured to at least partially block the second flow passage;

wherein the first flow passage is disposed vertically above the heating chamber and the second flow passage is disposed vertically above the first flow passage.

* * * * *